US007597434B2

(12) United States Patent
Nitta et al.

(10) Patent No.: US 7,597,434 B2
(45) Date of Patent: Oct. 6, 2009

(54) INK-JET APPARATUS AND METHOD OF THE SAME

(75) Inventors: Noboru Nitta, Tagata-gun (JP); Masashi Shimosato, Izunokuni (JP); Hideaki Nishida, Izunokuni (JP); Isao Suzuki, Mishima (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 199 days.

(21) Appl. No.: 11/694,551

(22) Filed: Mar. 30, 2007

(65) Prior Publication Data

US 2007/0252860 A1 Nov. 1, 2007

(30) Foreign Application Priority Data

Apr. 27, 2006 (JP) ..... 2006-123927

(51) Int. Cl.
*B41J 2/18* (2006.01)

(52) U.S. Cl. ..... 347/89; 347/85; 347/7

(58) Field of Classification Search ..... 347/5–7, 347/9, 85, 89, 92
See application file for complete search history.

(56) References Cited

U.S. PATENT DOCUMENTS 4,929,963 A * 5/1990 Balazar ..... 347/89
7,083,253 B2 8/2006 Kimura et al.
7,097,287 B2 * 8/2006 Nakao et al. ..... 347/85
2002/0118256 A1 8/2002 Dixon et al.
2005/0007399 A1 1/2005 Harvey et al.
2008/0158307 A1 7/2008 Nitta et al.
2008/0158320 A1 7/2008 Nitta et al.
2008/0158321 A1 7/2008 Nitta et al.

FOREIGN PATENT DOCUMENTS

JP 55-121074 9/1980
JP 2000-289222 10/2000
JP 2005-161633 6/2005

* cited by examiner

*Primary Examiner*—Lam S Nguyen
(74) *Attorney, Agent, or Firm*—Turocy & Watson, LLP

(57) ABSTRACT

"Energy per unit volume" P2(Pa) generated in ink 4 in a second ink tank 14 is maintained to the condition "P2={(1+r)×Pn}−(r×P1)" based on "energy per unit volume" P1(Pa) generated in ink 4 in the first ink tank 12, a proportion of "1:r" between channel resistance R1 (Pa·sec/m$^3$) of ink from the first ink tank 12 to the neighborhood of a nozzle 1 and channel resistance R2 (Pa·sec/m$^3$) of ink from the neighborhood of the nozzle 1 to the second ink tank 14, and appropriate pressure Pn (Pa) of the ink 4 in the neighborhood of the nozzle 1.

24 Claims, 8 Drawing Sheets

| | Rt(Pa · sec/m$^3$) | Q(m$^3$/sec) | Pd(Pa) | Qh(m$^3$/sec) |
|---|---|---|---|---|
| 1 | 3.40E+09 | 1.50E-06 | 5,016 | 1.50E-06 |
| 2 | 1.74E+09 | 3.03E-06 | 5,107 | 1.53E-06 |
| 3 | 1.21E+09 | 4.62E-06 | 5,289 | 1.59E-06 |
| 4 | 9.46E+09 | 6.29E-06 | 5,568 | 1.67E-06 |
| 5 | 7.97E+09 | 8.07E-06 | 5,947 | 1.78E-06 |
| 6 | 1.50E+09 | 1.00E-05 | 6,433 | 1.93E-06 |
| 7 | | | 14,993 | |

FIG. 12

| | Valve (74) | Valve (72) | Valve (75) | Valve (73) | Function | Pump (69) |
|---|---|---|---|---|---|---|
| 1 | Closed | Closed | Opened | Opened | Generating differential pressure | Normal rotation |
| 2 | Leak | Closed | Closed | Opened | Filling positive pressure | Normal rotation |
| 3 | Closed | Leak | Opened | Closed | Filling negative pressure | Normal rotation |
| 4 | Leak | Leak | Closed | Closed | Retaining pressure | Stopped |
| 5 | Leak | Leak | Opened | Opened | Shut down | Stopped |
| 6 | Leak | Closed | Opened | Closed | Negative pressure leak | Stopped |
| 7 | Closed | Leak | Closed | Opened | Positive pressure leak | Stopped |

FIG. 13

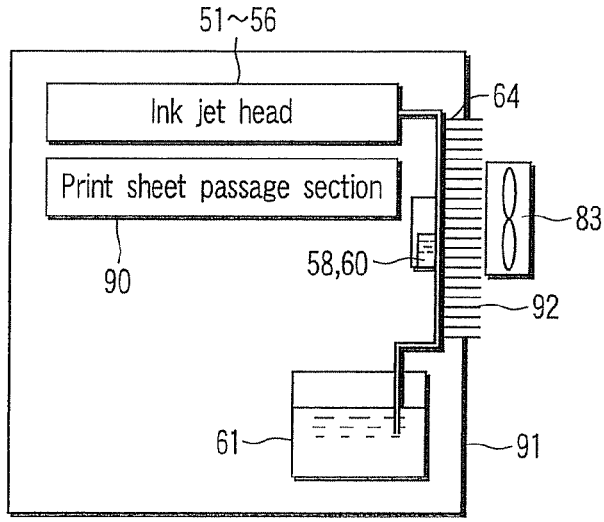

FIG. 14

INK-JET APPARATUS AND METHOD OF THE SAME

CROSS-REFERENCE TO RELATED APPLICATIONS

This application is based upon and claims the benefit of priority from the prior Japanese Patent Application No. 2006-123927, filed Apr. 27, 2006, the entire contents of which are incorporated herein by reference.

BACKGROUND OF THE INVENTION

1. Field of the Invention

The present invention relates to an ink jet apparatus that circulates ink through an ink jet head and ejects ink from nozzles of the ink jet head, and a control method thereof.

2. Description of the Related Art

Conventionally, the ink jet apparatus that circulates ink through an ink jet head and ejects ink from nozzles of the ink jet head has been known. For example, there are the ink jet apparatuses described in US 2002/0118256A1 and US 2005/0007399A1.

It is important for such an ink jet apparatus that the pressure of ink at the neighborhood of nozzle openings of the ink jet head should be always maintained at a constant level.

The ink jet apparatus described in US 2002/0118256A1 has a problem that although the pressure of ink at the neighborhood of nozzle openings largely depends on channel resistance of the pipeline between an ink tank and the ink jet head, the pressure of ink at the neighborhood of the nozzle openings is not constant because no consideration is given to the channel resistance.

On the one hand, the ink jet apparatus described in US 2005/0007399A1 comprises a pressure reference. Liquid level control is difficult for the pressure reference. Furthermore, there is a problem that since a large quantity of ink should be supplied to the pressure reference by a pump, the pump consumes much energy to operate.

An object of the present invention is to provide an ink jet apparatus that can always maintain the pressure of ink at the neighborhood of nozzle openings at an appropriate pressure without requiring complicated control and without involving considerable energy consumption.

BRIEF SUMMARY OF THE INVENTION

An ink jet apparatus of the present invention comprises:

at least one ink jet head having a pressure chamber communicated to nozzles and ejecting ink from the nozzles communicated to the pressure chamber;

a first pressure source containing ink, and generating "energy per unit volume" P1 (Pa) based on static ink of atmospheric pressure at height position of openings of the nozzles;

a second pressure source containing ink, and generating "energy per unit volume" P2 (Pa) based on static ink of atmospheric pressure at height position of openings of the nozzles; and a control means, wherein the first pressure source, the pressure chamber, and the second pressure source are sequentially connected by first and second channels.

Given that a ratio of channel resistance of the channel to the first pressure source from a branching point that branches from the first and second channels to the nozzles, versus channel resistance of the channel from the branching point to the second pressure source is set as "1:r", the control means keeps the "energy per unit volume" P2 (Pa) in accordance with the relation $P2=\{(1+r)\times Pn\}-(r\times P1)$ at least when ejecting ink from the nozzles.

The Pn represents an appropriate pressure of ink at the neighborhood of the nozzle openings.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

FIG. 12 is a view showing a spreadsheet in the fifth embodiment.

FIG. 13 is a view showing each operation pattern in the fifth embodiment.

FIG. 14 is a view showing a specific configuration of a radiator and the periphery thereof in the fifth embodiment.

DETAILED DESCRIPTION OF THE INVENTION

[1] FIRST EMBODIMENT

In the following, a first embodiment of the present invention will be described with reference to the drawings.

Figure 1:
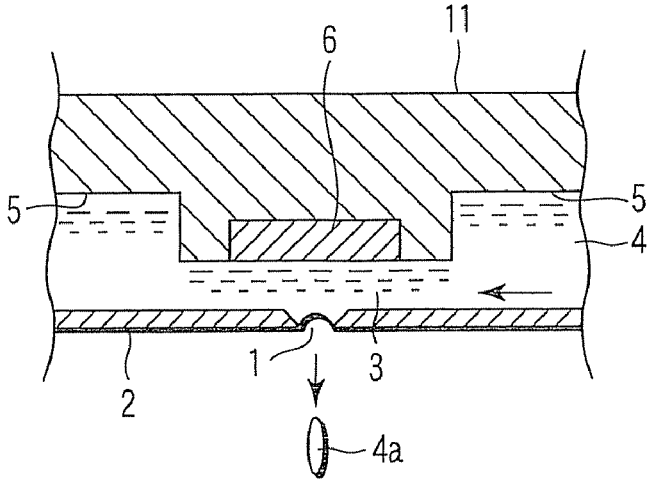
FIG. 1 is a section view showing the internal structure of an ink jet head of first to seventh embodiments.

FIG. 1 shows a cross section of an ink jet head 11 of an ink circulating type. That is, a pressure chamber 3 is formed on a top surface side of an orifice plate 2 having a nozzle 1 for ejecting ink. Formed as a middle part of a channel 5 in the head which ink 4 runs through is narrowed, the pressure chamber 3 not only has the above-mentioned nozzle 1, but also has an actuator 6 on the surface side opposed to the nozzle 1. The ink 4 runs from right to left as shown in the figure, through the pressure chamber 3, in the channel 5 within the head.

As the actuator 6 is driven, the ink 4 within the pressure chamber 3 forms an ink droplet 4*a* and is ejected from the nozzle 1. As the actuator 6, those directly or indirectly transforming the pressure chamber 3 by use of a piezoelectric device such as a PZT are known. Furthermore, as the ink jet head, any of those driving a diaphragm by static electricity, those heating ink by a heater and producing air bubbles to generate pressure, those directly moving ink 4 by static electricity, and like may be used. The position where the actuator 6 is to be provided is not limited to the surface side opposed to the nozzle 1, but may be a surface located in the depth direction of the figure, for example. In addition, the ink 4 in the pressure chamber 3 is not necessarily to be ejected from the nozzle 1 directly, and the pressure chamber 3 may be communicated with the nozzle 1 so that the ink 4 is ejected from the nozzle 1 when the actuator 6 is driven for generating pressure in the pressure chamber 3.

Figure 2:
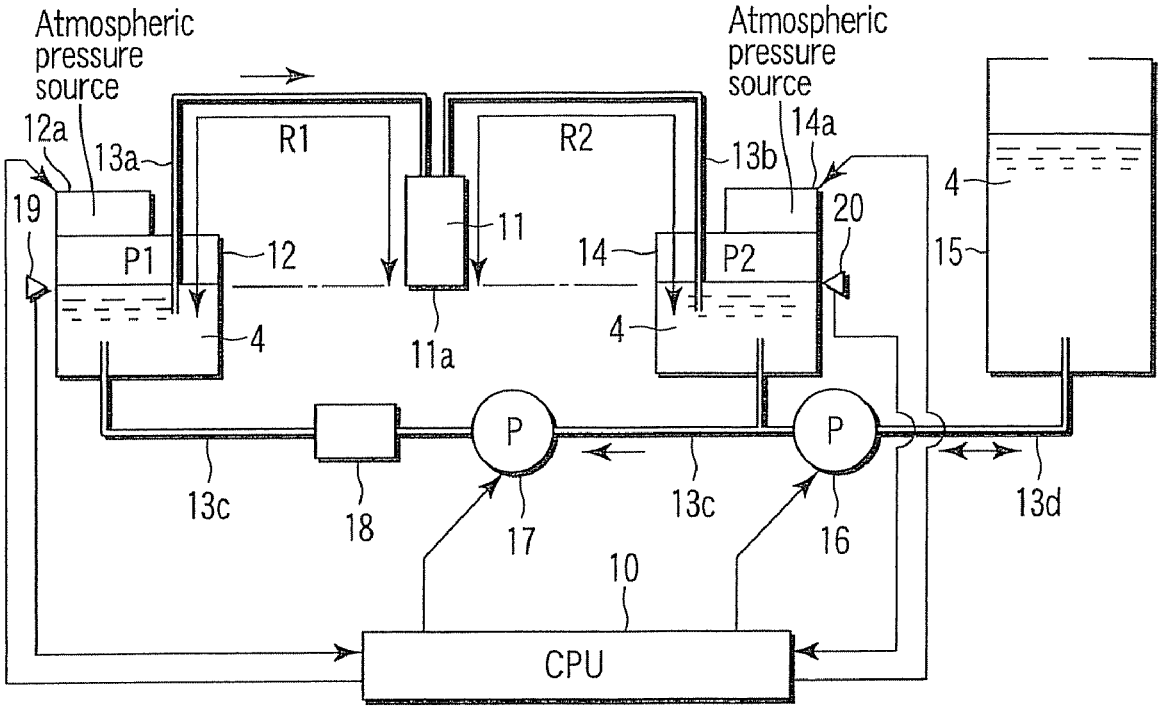
FIG. 2 is a view showing the configuration of the first embodiment.

FIG. 2 shows the overall configuration.

A first ink tank 12 serving as a first pressure source is provided. The first ink tank 12 not only contains the ink 4 for supply to the pressure chamber 3 in the ink jet head 11, but also additionally comprises a first atmospheric pressure source 12*a* and generates to the ink 4 "energy per unit volume" P1 ($N \cdot m/m^3$) that is based on static ink of atmospheric pressure at the height position of an opening of the nozzle 1. The unit $N \cdot m/m^3$ is equal to Pascal (Pa). This "energy per unit voltage" P1 (Pa) refers to the "energy per unit volume" of the "Bernoulli equation" and a sum (value) of static pressure, dynamic pressure and potential pressure. In the following description, unless otherwise specified, a reference height of the potential pressure shall be a height position of the opening of the nozzle 1, and a reference of the "energy per unit volume" shall be static ink of atmospheric pressure at the height position of the opening of the nozzle 1.

When dynamic pressure can be ignored, "energy per unit volume" P1 is expressed as a sum (value) "Pi1+ρ·g·h1" of static pressure Pi1 of the ink 4 at liquid level within a first ink tank 12 and potential pressure "ρ·g·h1" of the ink 4 at liquid level within the first ink tank 12. ρ($kg/m^3$) is density of the ink 4. g($m/s^2$) is gravity acceleration rate of the ink 4. h1(m) is a height position at the liquid level of the ink 4 within the first ink tank 12 based on the height position of the opening of the nozzle 1, i.e., a so-called potential head. As described later, in this embodiment, as control is exercised so that "h1=0", it is "Pi1=P1".

The ink 4 within the first ink tank 12 is guided into an inflow ink port of the ink jet head 11 by a first ink channel 13*a*. The guided ink 4 runs through the pressure chamber 3 of the ink jet head 11 and flows out from an outflow ink port into a second ink channel 13*b*. The ink 4 flowing out into the second ink channel 13*b* is guided to a second ink tank 14 that is a second pressure source.

The second ink tank 14 receives the ink 4 flowing out from the pressure chamber 3 of the ink jet head 11, and additionally comprises a second atmospheric pressure source 14*a*, which generates an "energy per unit volume" P2 (Pa) within the ink 4.

When dynamic pressure can be ignored, the "energy per unit volume" P2 is expressed as a sum (value) "Pi2+ρ·g·h2" of static pressure Pi2 of the ink 4 at the liquid level within the second ink tank 14 and potential pressure "ρ·g·h2" at the liquid level of the ink 4 within the second ink tank 14. h2(m) is a height position at the liquid level of the ink 4 within the second ink tank 14 that is based on a height position of the opening of the nozzle 1, i.e., potential head. As described later, in this embodiment, as control is exercised so that "h2=0", it is "Pi2=P2".

Here, a supplementary explanation of "energy per unit volume" of the "Bernoulli equation" of the ink 4 in the first ink tank 12 is given.

As described earlier, the pressure of the ink 4 at the liquid level within the first ink tank 12 and the "energy per unit volume" of the "Bernoulli equation" are both P1(=Pi1).

In addition, the potential pressure of the ink 4 at the liquid level within the first ink tank 12 is 0.

Next, the "energy per unit volume" of the "Bernoulli equation" of ink 4 at a location that is x deep under the liquid level within the first ink tank 12 is considered. The pressure of the ink 4 at the location that is just x(m) deep under the liquid level is "P1+ρ·g·x", which is just "ρ·g·x" higher than the pressure at the liquid level. On the one hand, the potential pressure of the ink 4 at a location that is just x deep under the liquid level decreases from that at the liquid level by "ρ·g·x", and is "−ρ·g·x". Therefore, by summing the "P1+ρ·g·x" and "−ρ·g·x", the "energy per unit volume" of the "Bernoulli equation" of the ink 4 at the location just x deep under the liquid level is "P1+ρ·g·x−ρ·g·x=P1". Thus, the "energy per unit volume" at the location that is just x deep under the liquid level does not differ from that at the liquid level. This is because by being x deep under the liquid level, the potential energy is simply replaced by pressure energy, and the total amount of energy does not change. The "energy per unit volume" of the "Bernoulli equation" of the ink 4 within the first ink tank 12 has been described above, but the description also applies to the "energy per unit volume" of the "Bernoulli equation" of the ink 4 within the second ink tank 14. In general, when channel resistance within a container and kinetic energy of ink can be ignored, because of "Bernoulli's theorem" the "energy per unit volume" of the "Bernoulli equation" of ink within the container is uniform everywhere within the container, irrespective of how deep it is from the liquid level. Therefore, ink within this container can be considered a pressure source that generates the "energy per unit volume" of the "Bernoulli equation".

For example, if an attempt to eject ink by connecting a flexible tube to the container is made, the pressure to be applied to the mouth of the tube varies depending on a height position of the ejection port to be connected. However, the potential pressure of the mouth of the tube varies by the same amount as the pressure, but in a reverse relationship. Thus, if the negative load from the tube of attempting to eject ink remains unchanged, the flow of ink running into the tube is the same, from whatever height position of the container ink is ejected, and is thus determined by the "energy per unit volume" of the "Bernoulli's equation" of the ink within the container and the negative load from the tube.

A third ink channel 13*c* is provided between the second ink tank 14 and the first ink tank 12. In a second pump 17 and a filter 18 are provided in the third ink channel 13*c*, and the ink 4 is fed to the first ink tank 12 by operation of the second pump 17. The filter 18 removes foreign matter mixed into the ink 4 running through the third ink channel 13*c*.

The first ink tank 12, the first ink channel 13*a*, the ink jet head 11, the second ink channel 13*b*, the second ink tank 14, the third ink channel 13*c*, the second pump 17, and the filter 18 form a circulating path for the ink 4.

Further, a main tank 15 in which the ink 4 is contained and which is opened to the atmospheric pressure is provided. A fourth ink channel 13*d* is provided between this main tank 15 and the third ink channel 13*c* (side closer to the second ink tank 14).

A first liquid level sensor 19 is provided in the first ink tank 12 to detect a height position of the liquid level of the ink 4 therein. A second liquid level sensor 20 is provided in the second ink tank 14 to detect a height position of the liquid level of the ink 4 therein. Detection results by these liquid level sensors 19, 20 are supplied to CPU 10.

A first pump 16 is provided in the fourth ink channel 13*d*. The first pump 16 is controlled by CPU 10 to increase or decrease an amount of the ink 4 within the circulating path so that a height position detected by the second liquid level sensor becomes equal to that of the opening of the nozzle 1 of the ink jet head 11. In other words, while the height position detected by the second liquid level sensor 20 is lower than that of the opening of the nozzle 1 of the ink jet head 11, the ink 4 is fed to the circulating path. While the height position detected by the second liquid level sensor 20 is higher than that of the opening of the nozzle 1 of the ink jet head 11, the ink 4 is returned to the main tank 15 from the circulating path.

On the one hand, the second pump 17 is controlled by CPU 10 so that a height position detected by the first liquid level sensor 19 becomes equal to that of the opening of the nozzle 1 of the ink jet head 11. In other words, while the height position detected by the first liquid level sensor 19 is lower than that of the opening of the nozzle 1 of the ink jet head 11, the second pump 17 is accelerated or driven. While the height position detected by the first liquid level sensor 19 is higher than that of the opening of nozzle 1 of the ink jet head 11, the CPU decelerates or stops the second pump 17.

Thus, the liquid level of the ink 4 within the first ink tank 12 and that of the ink 4 within the second ink tank 14 are maintained at the same height position as that of the opening of the nozzle 1 of the ink jet head 11.

The "energy per unit volume" P1 of the ink 4 within the first ink tank 12 and the "energy per unit volume" P2 of the ink 4 within the second ink tank 14 correspond to the atmospheric pressure of the atmospheric pressure source 12*a* and that of the atmospheric pressure source 14*a*. These atmospheric pressures are controlled by CPU 10.

Here, if "P1>P2" is set, the ink 4 within the first ink tank 12 flows into the second ink tank 14 through the neighborhood of the nozzle 1 of the pressure chamber 3 in the ink jet head 11. At the same time, the ink 4 within the second ink tank 14 returns to the first ink tank 12 through the third ink channel 13*c*, the second pump 17 and the filter 18, thus circulating in the circulating path.

In such an ink supply system that supplies ink to the ink jet head 11, dynamic pressures at any location within the circulating path are small enough to be ignored. In addition, as the Reynolds number at any location within the circulating path is also sufficiently small, and effects of turbulent flow of the ink 4 can be ignored.

In the following, a description of the case in which "ejected amount per unit time" of the ink 4 in the nozzle 1 is sufficiently small in comparison to the flow rate of the ink 4 in the pressure chamber 3 will be continued. In this case, the pressure loss within the ink jet head 11 and the ink supply system to the ink jet head 11 depends largely on the circulation flow rate rather than on the ink ejection amount.

The flow Q($m^3$/sec) of the ink 4 flowing in the ink channel that runs from the first ink tank 12 to the second ink tank 14 through the neighborhood of the nozzle 1 of the pressure chamber 3 is expressed in the following formula (1):

$$Q=(P1-P2)/(R1+R2) \tag{1}$$

wherein R1(Pa·sec/$m^3$) is the channel resistance of the ink 4 from the first tank 12 to the neighborhood of the nozzle 1 in the pressure chamber 3, and R2(Pa·sec/$m^3$) is the channel resistance of the ink 4 from the neighborhood of the nozzle 1 in the pressure chamber 3 to the second ink tank 14.

In other words, the ink flow rate Q is determined by the channel resistances R1, R2 and the difference between the "energy per unit volume" P1 of the ink 4 within the first ink tank 12 and the "energy per unit volume" P2 of the ink 4 within the second ink tank 14.

The channel resistances R1, R2 are decided by the viscosity of the ink 4 and shape of the channel. Thus, to adjust the ink flow rate Q to a predetermined value, the values of the "energy per unit volume" P1, P2 will be adjusted. In fact, CPU 10 adjusts the values of P1, P2 by adjusting either the atmospheric pressure of the atmospheric pressure source 12*a* or atmospheric pressure of the atmospheric pressure source 14*a*, or both of them, thereby obtaining desired ink flow rate Q. For example, if the "energy per unit volume" P1 is increased or the "energy for unit volume" P2 is decreased, the ink flow rate Q can be increased. Conversely, the ink flow Q can be decreased if the "energy per unit volume" P1 is decreased or the "energy per unit volume" P2 is increased.

At the same time, CPU 10 maintains a relationship of "energy per unit volume" P1, P2, as shown in the following formula (2), wherein Pn is a constant.

$$P2=\{(R1+R2)/R1\}\times Pn-(R2/R1)\times P1 \tag{2}$$

When no ink 4 is ejected, the pressure (Pa) of the ink 4 in the neighborhood of the opening of the nozzle 1 is "P2+Q×R2". If the formulas (1) and (2) are substituted into the "P2+Q×R2", the following formula (3) is developed:

$$\begin{aligned} P2+Q\times R2 &= P2+\{(P1-P2)/(R1+R2)\}\times R2 \\ &= \{1-R2/(R1+R2)\}\times P2+\{R2/(R1+R2)\}\times P1 \\ &= \{R1/(R1+R2)\}\times P2+\{R2/(R1+R2)\}\times P1 \\ &= Pn-\left\{\begin{matrix} R1/(R1+R2)\times \\ (R2/R1)\times P1 \end{matrix}\right\}+\{R2/(R1+R2)\}\times P1 \\ &= Pn \end{aligned} \tag{3}$$

In other words, the constant Pn corresponds to the pressure (Pa) of the ink 4 in the neighborhood of the opening of the nozzle 1, and a value contained in the range of, for example, 0 (Pa) to −3000 (Pa) is selected so that the surface of the ink at the opening of the nozzle 1 retains a meniscus (refer to FIG. 1) curving to the inner side of the opening. If the constant Pn is greater than 0 (Pa), the ink 4 may leak from nozzle 1. If it is smaller than −3000 (Pa), extra air may be sucked into the nozzle 1. In the following, the constant Pn is referred to as the appropriate pressure of the ink 4 in the neighborhood of the opening of the nozzle 1.

While the ejection operation of the ink 4 is performed, the pressure of the ink 4 in the neighborhood of the opening of the nozzle 1 widely varies at high frequencies due to ejection. However, when the ink 4 is ejected, the meniscus is intentionally broken due to the ejection. Thus, the appropriate pressure Pn of the ink 4 in the neighborhood of the opening of the nozzle 1 that is to be maintained herein refers to a mean value excluding the high frequency components due to the ejection operation, or pressure during a pause between an ejection operation and a next ejection operation.

Strictly speaking, the pressure of the ink 4 in the neighborhood of the opening of the nozzle 1 is a value obtained by adding the potential pressure attributable to a slight difference of evaluation between the neighborhood of the nozzle 1 in the pressure chamber 3 and the neighborhood of the opening of the nozzle 1, to the pressure in the neighborhood of the nozzle 1 in the pressure chamber 3.

If the relationship of channel resistances R1, R2 is "R1=R2", the formula (2) of the "energy per unit volume" P2 is simpler, as shown in the following formula (4):

$$P2=2\cdot Pn-P1 \tag{4}$$

In addition, if a proportion of the channel resistance R1 and channel resistance R2 is expressed as "1:r" (in other words, R2/R1=r), the formula (2) of the "energy per unit volume" P2 is as shown in the following formula (5):

$$P2=\{(1+r)\times Pn\}-(r\times P1) \tag{5}$$

In other words, the relationship of the "energy per unit volume" P1 and P2 for maintaining the appropriate pressure Pn of the ink 4 in the neighborhood of the opening of the nozzle 1 is not influenced by absolute values of the channel resistances R1, R2, and determined only by the proportion of the channel resistance R1 and the channel resistance R2 "1:r".

In the conventional ink jet apparatus, if the pressure loss generated due to the channel resistance in a channel connecting a pressure source and an ink jet head is high, it is difficult to maintain the pressure of ink 4 in the neighborhood of an opening of a nozzle 1 at an appropriate pressure. In particular, for example, in the case in which the pressure loss generated by the channel resistance in the channel connecting the pressure source and the ink jet head (strictly speaking, loss of the "energy per unit volume" of ink 4) accounts for more than half of the magnitude (range) of the "range of the appropriate pressure of the ink 4 in the neighborhood of the opening of the nozzle 1", in other words, for instance, if a value obtained by multiplying the channel resistance of the channel connecting the pressure source and the ink jet head by flow rate of this channel exceeds 1500 (Pa), it is quite difficult to keep the pressure of the ink 4 in the neighborhood of the opening of the nozzle 1 at the appropriate pressure. However, according to the present invention, the pressure of the ink 4 in the neighborhood of the opening of the nozzle 1 is not influenced by absolute values of the channel resistances R1, R2, and is determined only by the proportion of the channel resistance R1 and the channel resistance R2. Thus, even when the pressure loss due to the channel resistance R1 and the channel resistance R2 exceeds a total of 3000 (Pa), the pressure of the ink 4 in the neighborhood of the opening of the nozzle 1 can be maintained at the appropriate pressure.

In addition, if the viscosity of the ink 4 changes due to a difference in ambient temperatures, or a different kind of ink 4 having a different viscosity is used, the absolute values of the channel resistances R1, R2 change. However, if the viscosity of the ink 4 within the circulating path is uniform, the proportion of the channel resistance R1 and the channel resistance R2 "1:r" is kept constant as far as physical forms of the ink channels 13*a*, 13*b* remain unchanged. In other words, if CPU 10 controls the relationship of the "energy per unit volume" P1, P2 so that the formula (5) can be maintained, the pressure in the neighborhood of the nozzle 1 in the pressure chamber 3 can be kept constant even if the ambient temperature or kind of ink 4 differs.

For example, when a cross-section area of the ink channel 13*a* in the upstream side from the nozzle 1 is the same as that of the ink channel 13*b* in the downstream side from the nozzle 1, a proportion of the length of the ink channel 13*a* and that of the ink channel 13*b* corresponds to the proportion of the channel resistance R1 and the channel resistance R2, namely "1:r", the "energy per unit volume" P2 may be set based on the formula (5) that uses the proportion. As a result, the pressure of the ink 4 in the neighborhood of the opening of the nozzle 1 can be kept at the appropriate pressure Pn.

Although the ink flow rate Q changes if the absolute values of the channel resistances R1, R2 change, pressure changes or effects of turbulent flow can be ignored if the dynamic pressure of the ink 4 running through the pressure chamber 3 is small and the Reynolds number in the pressure chamber 3 is small. Thus, unless the ink flow rate Q changes exponentially, a change in the ink flow Q does not directly affect the ejection operation of the ink 4. In contrast to this, the pressure of the ink 4 in the neighborhood of the opening of the nozzle 1 directly affects the ejection operation of the ink 4. Thus, keeping the pressure of the ink 4 in the neighborhood of the opening of the nozzle 1 appropriate is more important than keeping the ink flow rate Q, and is a condition to be prioritized.

Nevertheless, when the ink flow rate Q varies too widely, problems such as poor performance of a pump to be used or inadequate capacity of an ink tank, and reduction of the homogenization effect of ink temperatures or air bubble removal effect that are advantages of circulation of ink 4 arise. Thus, to prevent a change in the ink flow rate Q from becoming too substantial, the "energy per unit volume" P1 of the first ink tank 12 may be corrected, with respect to viscosity of the ink 4.

If the channel resistance proportion r and the constant Pn are used in place of the "energy per unit volume" P2, the formula (1) that expresses the ink flow rate Q is developed as shown in the following formula (6):

$$\begin{aligned} Q &= (P1-P2)/(R1+R2) \\ &= (1+r)(P1-Pn)/(R1+R2) \end{aligned} \tag{6}$$

If "R1+R2" has increased as the viscosity of the ink 4 increased, a change of the ink flow rate Q can be prevented by adjusting the "energy per unit volume" P2 according to the formula (5), while the "energy per unit volume" P1 is increased so that "P1−Pn" is higher.

When the ink flow rate Q and all-channel resistance R, which is the combined resistance of the channel resistances R1, R2 is used, the "energy per unit volume" P1 to be given is expressed by the following formula (7):

$$P1=Q\cdot R/(1+r)+Pn \tag{7}$$

As the all-channel resistance R is proportional to viscosity of the ink 4, a change in the ink flow rate Q can be prevented if the "energy per unit volume" P2 is adjusted according to the formula (5), while adjusting the "energy per unit volume" P1 depending on the viscosity of the ink 4 by using this formula (7). For the reasons that have already been mentioned, this adjustment does not need to be so rigorous. In addition, regardless of whether this adjustment was performed or not, the pressure of the ink 4 in the neighborhood of the opening of the nozzle 1 can be kept at the appropriate pressure Pn if a form of control to set the "energy per unit volume" P2 according to any condition of the formulas (2), (4), and (5) is adopted.

Although here the case in which the ink flow rate Q is adjusted by increasing or decreasing the "energy per unit volume" P1, and the "energy per unit volume" P2 is set so that the appropriate pressure Pn can be obtained is described, on the contrary, the ink flow rate Q may be adjusted by increasing or decreasing the "energy per unit volume" P2, and the "energy per unit volume" P1 may be set so that the appropriate pressure Pn can be obtained.

In the formulas (2), (4) and (5), a value of the "energy per unit volume" P2 for obtaining the appropriate pressure of the ink 4 in the neighborhood of the opening of the nozzle 1 is given as a function of the "energy per unit volume" P1. Conversely, the respective formulas may be solved for the "energy per unit volume" P1, and a value of the "energy per unit volume" P1 for obtaining the appropriate pressure of the ink 4 in the neighborhood of the opening of the nozzle 1 may be given as a function of the "energy per unit volume" P2. The point is that the relationship of the "energy per unit volume" P1, P2 may satisfy any of the formulas (2), (4), or (5).

In addition, it is possible to perform maintenance in which any foreign matter, air bubble and the like present within the ink jet head 11 may be pushed away to the downstream side by increasing the "energy per unit volume" P1 and thereby increasing the ink flow rate Q. With continued control for setting the "energy per unit volume" P2 according to any of the conditions of the formulas (2), (4), or (5) even during this, the pressure of the ink 4 in the neighborhood of the opening of the nozzle 1 can be kept at the appropriate pressure Pn. Therefore, during maintenance, neither ink will leak from the nozzle 1 nor unwanted air will flow into the nozzle 1. That is, economic and efficient maintenance is possible without breaking the meniscus of the ink 4 at the opening of the nozzle 1.

To wash away any foreign matter, air bubble and the like present within the ink jet head 11 to the downstream side, the ink flow rate Q may be as high as possible. However, if the highest ink flow rate Q is maintained at all times, there are concerns that the life of the pump 17 will be adversely affected, the pump 17 may generate noise, the ink channels 13*a*, 13*b*, 13*c* may deteriorate, the filter 18 may deteriorate, the ink 4 may receive unwanted stress, air bubbles may mix from any location of the ink channels 13*a*, 13*b*, 13*c*, and will be fed to the ink jet head 11 or the like. Thus, it is desirable to increase the ink flow rate Q only when necessary. In this embodiment, even if the ink flow rate Q is changed, the pressure of the ink 4 in the neighborhood of the opening of the nozzle 1 can be controlled to the appropriate pressure Pn. Thus, such use (use in which the ink flow rate Q is increased only when necessary) is possible.

In addition, in doing maintenance, the pressure of the ink 4 in the neighborhood of the opening of the nozzle 1 may be set higher than usually appropriate pressure on purpose, thereby the ink 4 is forcibly ejected from the nozzle 1. This enables such operations as wetting the periphery of the opening of the nozzle 1 with the ink 4, pushing out any foreign matter (including solidified ink 4) present inside the opening of the nozzle 1 from the nozzle 1, removing any foreign matter attached to the periphery of the opening of the nozzle 1, etc.

When a plurality of ink jet heads 11 are incorporated, the configuration can be such that the ink 4 is guided from the first ink tank 12 respectively through a plurality of ink channels 13*a* into respective ink jet heads 11, and then the ink 4 that has gone through the respective ink jet heads 11 is guided respectively through a plurality of ink channels 13*b* into the second ink tank 14. In this case, if each of the plurality of ink channels 13*a* mutually has the same thickness and length and yet each of the plurality of ink channels 13*b* mutually has the same thickness and length, the flow rate of the ink 4 running through the plurality of ink jet heads 11 and pressure of the ink 4 in the neighborhood of the opening of the nozzle 1 can be matched, respectively.

However, in general, as ink jet heads 11 located closer to the first ink tank 12 and the second ink tank 14 and ink jet heads 11 located far therefrom are mixed together, it is frequently difficult to match the lengths of the plurality of ink channels 13*a* or the lengths of the plurality of ink channels 13*b*.

In this case, if the channel resistances of the ink 4 from the first ink tank 12 to the neighborhood of the nozzle 1 in the pressure chamber 3 of the respective ink jet heads 11 are expressed as R11, R12, R13, . . . , and the channel resistances of the ink 4 from the neighborhood of the nozzle 1 in the pressure chamber 3 of the respective ink jet heads 11 to the second ink tank 14 are expressed as R21, R22, R23, . . . , satisfying the condition of "R21/R11=R22/R12=R23/R13= . . . " makes it possible to mutually keep the pressure of the ink 4 at the same value in the neighborhood of the opening of the nozzle 1 in the respective ink jet heads 11, although the flow rates among the respective ink jet heads 11 are not necessarily identical. At this time, with a proportion of the channel resistance of the ink 4 from the first ink tank 12 to the neighborhood of the nozzle 1 in the pressure chamber 3 of the respective ink jet heads 11 and the channel resistance from the neighborhood of the nozzle 1 in the pressure chamber 3 of the respective ink jet heads 11 being "R21/R11=R22/R12=R23/R13= . . . =r", if the relationship of P1, P2 is controlled according to the formula (2) or (5), or furthermore if with the proportion being "r=1", the relationship of P1, P2 is controlled according to the formula (4), it is possible to maintain the appropriate pressure of the ink 4 in the neighborhood of the opening of the nozzle 1 of each ink jet head 11.

An ink jet head 11 is not limited to that with one nozzle 1, and those having a plurality of pressure chambers 3 and a plurality of nozzles 1 that are arranged in a direction orthogonal to the flow direction of the ink 4 (depth direction in FIG. 1) are also possible. For an ink jet head 11 having a plurality of pressure chambers 3 and a plurality of nozzles 1, if the channel resistances from an inflow side ink port of the ink jet head 11 to the neighborhood of the nozzles 1 in the respective pressure chambers 3 are expressed as Z11, Z12, Z13, . . . , and the channel resistances from the neighborhood of the nozzle 1 in the respective pressure chambers 3 to an outflow side ink port of the ink jet head 11 are expressed as Z21, Z22, Z23, . . . , then, satisfying the condition "Z21/Z11=Z22/Z12=Z23/Z13= . . . " makes it possible to keep the pressure of the ink 4 in the neighborhood of the openings of the respective nozzles 1 at mutually the same value.

So far the operations of the range when ink ejection amount per unit time of the ink 4 in the nozzle 1 is sufficiently smaller than the circulating flow and thus possible effect thereof can be ignored are reviewed. If the effect of the ink ejection amount per unit time cannot be ignored, however, the effect of the ink ejection amount per unit time may be combined with the configuration.

In other words, when pressure fluctuations against ejection flow rate of the ink supply system are considered, it can be thought that this ink supply system is equivalent to a supply system that supplies through the channel resistances "(R1×R2)/(R1+R2)" that is parallel resistances of the channel resistances R1, R2 from the pressure source of the appropriate pressure Pn. Thus, when the ink 4 is ejected from the nozzle 1, the pressure of the ink 4 in the neighborhood of the opening of the nozzle 1 becomes larger than the appropriate pressure Pn by the pressure loss generated by the ink 4 running through the parallel resistances of the channel resistances R1, R2.

Hence, absolute values of the channel resistances R1, R2 may be set to such a degree that this pressure loss can be allowed for.

However, as the pressure loss due to the channel resistance from the neighborhood of the nozzle 1 of the pressure chamber 3 to the neighborhood of the opening of the nozzle 1 is usually considered when operations of the actuator 6 are set for ejection, it is not considered herein.

In addition, so far it has been described that the dynamic pressure due to flow of the ink 4 in the vicinity of the nozzle 1 cannot be ignored. However, to be more exact, the current velocity of the ink 4 in the vicinity of the nozzle 1 may be calculated, and the appropriate pressure Pn may be increased by pressure drop due to dynamic pressure of this current velocity.

As described above, it is possible to always keep the pressure of ink 4 in the neighborhood of an opening of a nozzle 1 at appropriate pressure Pn, irrespective of a change of the ink flow rate Q and without requiring complicated control or considerable energy consumption.

[2] SECOND EMBODIMENT

Figure 3:
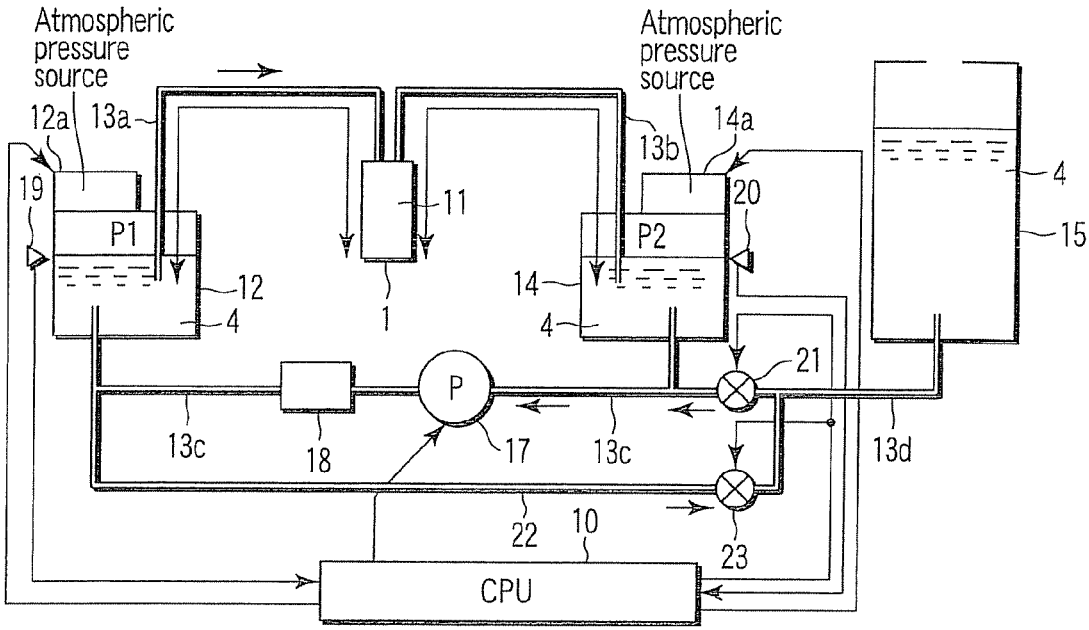
FIG. 3 is a view showing the configuration of the second embodiment.

When ink 4 circulates in the direction from the first ink tank 12 through the head to the second tank 14, the condition P1>P2 exists. If the "energy per unit volume" of the ink 4 within the main tank 15 lies between the "energy per unit volume" P1 and "energy per unit volume" P2, the ink supply system can be simplified by adopting a fifth ink channel 22, a first valve 21, and a second valve 23 in place of the first pump 16, as shown in FIG. 3.

The fifth ink channel 22 is provided between a region on the side closer to the first ink tank 12 of the third ink channel 13*c* and the fourth ink channel 13*d*.

The connecting point of the fifth ink channel 22 and the third ink channel 13*c* is provided in a location sufficiently close to the first ink tank 12. At this time, the "energy per unit volume" of the ink at the connecting point then can be considered as almost at P1.

The connecting point of the fifth ink channel 22 and the fourth ink channel 13*d* is provided in a location sufficiently close to the second ink tank 14. At this time, the "energy per unit volume" of the ink at the connecting point then can be considered as almost at P2.

The first valve 21 is provided at the connecting position of the third ink channel 13*c* in the fourth ink channel 13*d* and the connecting position of the fifth ink channel 22. The second valve 23 is provided in the fifth ink channel 22. Then, controlled by CPU 10, the first valve 21 and the second valve 23 increase or decrease an amount of the ink 4 in the circulating path, so that a height position detected by the second liquid level sensor 20 (a height position of the liquid level of the ink 4 within the second ink tank 14) is the same as a height position of the opening of the nozzle 1 of the ink jet head 11.

Similarly to the first embodiment, the second pump 17 is controlled according to a height position of the liquid level of the ink 4 within the first ink tank 12 that is detected by the first liquid level sensor 19.

If the height position of the liquid level of the ink 4 within the second ink tank 14 detected by the second liquid level sensor 20 is lower than the height position of the opening of the nozzle 1 of the ink jet head 11, the valve 21 is opened to replenish ink 4 to the second ink tank 14.

On the one hand, if the height position of the liquid level of the ink 4 within the second ink tank 14 detected by the second liquid level sensor 20 is higher than the height position of the opening of the nozzle 1 of the ink jet head 11, the valve 23 is opened to suck out the ink 4 from the first ink tank 12. At that time, in doing so, although the liquid level of the ink 4 within the first ink tank 12 descends once, the second pump 17 is then actuated to return the liquid level of the ink 4 within the first ink tank 12. Simultaneously the liquid level of the ink 4 within the second ink tank 14 descends.

Thus, similarly to the first embodiment, by opening or closing the valves 21, 23, the liquid level of the ink 4 within the second ink tank 14 can be controlled to be at the height position of the opening of the nozzle 1.

In configuration of this embodiment of an amount of the ink 4 within the circulating path is carried out for the flow rate to be defined by:

{
channel resistance of a path from the main tank 15 through the fourth ink channel 13d, the valve 21, the third ink channel 13c to the second ink tank 14,
and
a difference between the "energy per unit volume" of the ink 4 within the main tank 15 and the "energy per unit volume" of the ink 4 within the second ink tank 14
}.

Decreasing of an amount of the ink 4 within the circulating path is carried out for the flow rate to be defined by:

{
channel resistance of a path from the main tank 15 through the fourth ink channel 13d, valve 23, and the fifth ink channel 22, and the third ink channel 13c
and
a difference between the "energy per unit volume" of the ink 4 within the main tank 15 and the "energy per unit volume" P1 of the ink 4 within the first ink tank 12
}.

Other configurations and actions are the same as those of the first embodiment. Thus, description thereof is omitted.

[3] THIRD EMBODIMENT

Figure 4:
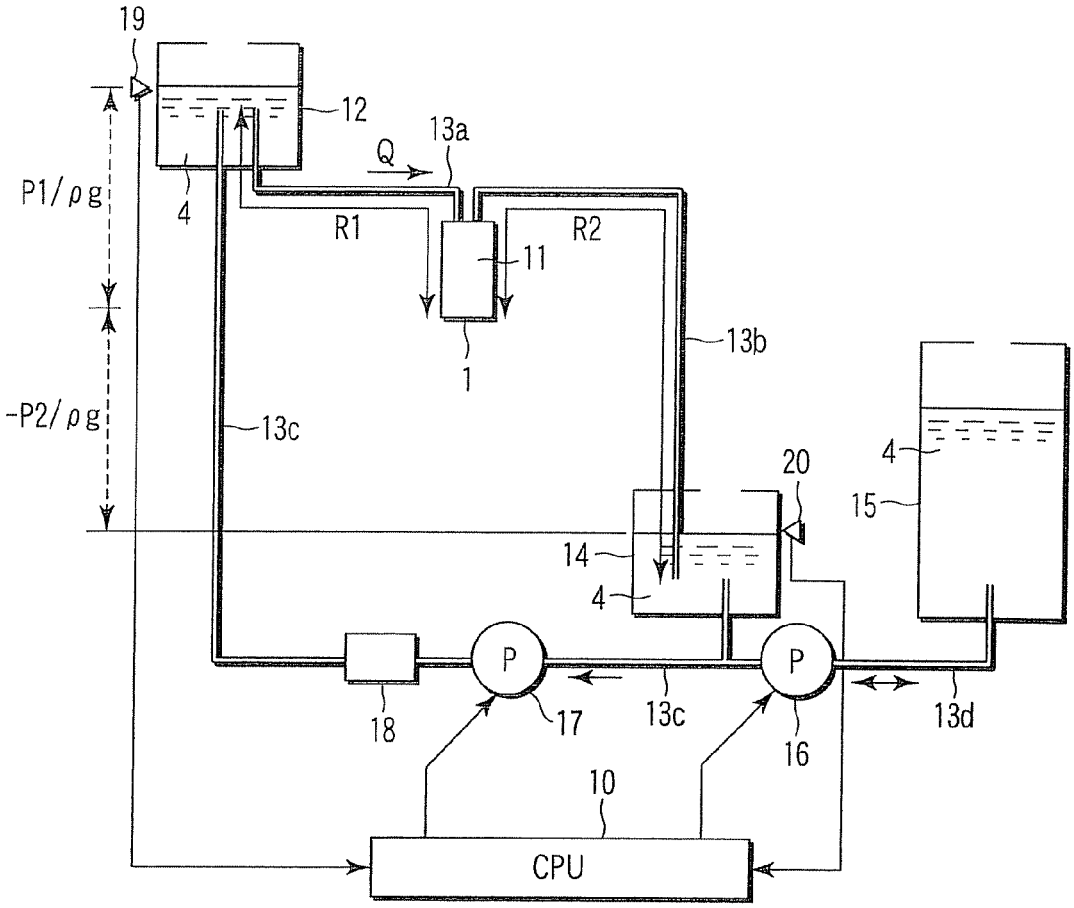
FIG. 4 is a view showing the configuration of the third embodiment.

As shown in FIG. 4, as a first pressure source, a first ink tank 12 that contains the ink 4 supplied to a pressure chamber 3 of an ink jet head 11 and that is opened to the atmosphere has been adopted. This first ink tank 12 is arranged at a higher position than an opening of a nozzle 1 of the ink jet head 11. The "energy per unit volume" P1 generated in the ink 4 of the liquid level of the first ink tank 12 is only the potential pressure, and is defined according to a height position of the liquid level of the ink 4 within the first ink tank 12 that is based on the height position of the opening of the nozzle 1. "P1/(ρ·g)" in FIG. 4 is this potential head (m).

As a second pressure source, a second ink tank 14 that contains the ink 4 flowing out from the pressure chamber 3 of the ink jet head 11 and that is opened to the atmosphere has been adopted. This second ink tank 14 is arranged at a position lower than the opening of the nozzle 1 of the ink jet head 11. The "energy per unit volume" P2 generated in the ink 4 within the second ink tank 14 is only the potential pressure, and is defined according to a height position of the liquid level of the ink 4 within the second ink tank 14 that is based on the height position of the opening of the nozzle 1. "−P2/(ρ·g)" in FIG. 4 is this potential head (m).

In other words, the difference in elevation between the height position of the opening of the nozzle 1 and the height position of the liquid level of the ink 4 within the first ink tank 12 is set in "P1/(ρ·g)"(m) and the difference in elevation between the height position of the opening of the nozzle 1 and the height position of the liquid level of the ink 4 within the second ink tank 14 is set in "−P2/(ρ·g)"(m), thus the same operations as those of the first embodiment may be achieved.

Other configurations and actions are the same as those of the first embodiment. Thus, description thereof is omitted.

In addition, in this embodiment, P1 and P2 are generated by opening both first and second pressure sources to the atmosphere and using the potential pressure. However, it is also possible to apply the first embodiment and this third embodiment in combination, wherein the configuration of the latter is adopted in either one of the first pressure source or the second pressure source, while the former is applied to the other.

[4] FOURTH EMBODIMENT

Figure 5:
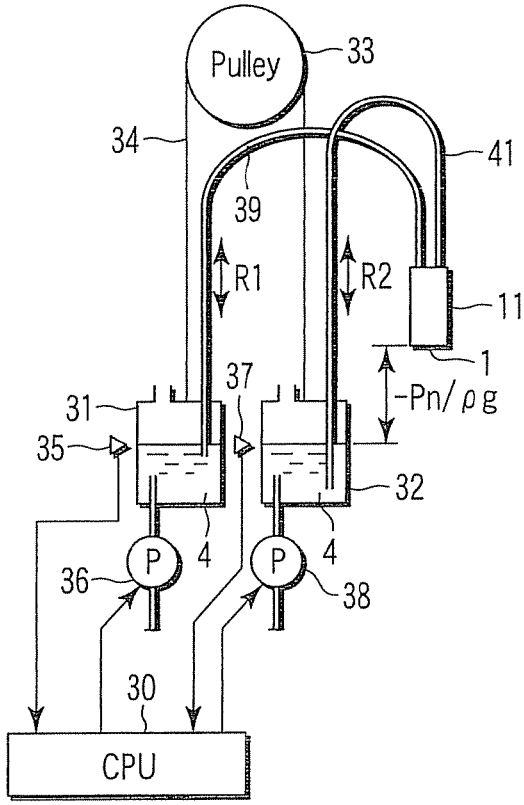
FIG. 5 is a view showing the configuration of the fourth embodiment.

As shown in FIG. 5, as a first pressure source, a first ink tank 31 that contains the ink 4 supplied to a pressure chamber 3 of an ink jet head 11 and that is opened to the atmosphere has been provided. A height position of the liquid level of the ink 4 within this first ink tank 31 (relative height to the first ink tank 31) is detected by the first liquid level sensor 35 installed in the first ink tank 31. The detection result of this first liquid level sensor 35 is supplied to CPU 30. CPU 30 controls a pump 36 to have the ink 4 enter and leave between an ink tank (not shown) and the first ink tank 31, thereby increasing or decreasing the amount of the ink 4 within the first ink tank 31, so that a height position detected by the first liquid level sensor 35 will be the same as a predetermined height position. A first ink channel 39 using a flexible liquid transport tube is provided between this first ink tank 31 and an inflow side ink port of the ink jet head 11.

As a second pressure source, a second ink tank 32 that contains ink 4 flowing out from the pressure chamber 3 of the ink jet head 11 and that is opened to the atmosphere is provided. A height position of this liquid level of the ink 4 within the second ink tank 32 (relative height to the second ink tank 32) is detected by a second liquid level sensor 37 installed in the second ink tank 32. The detection result of this second liquid level sensor 37 is supplied to CPU 30. CPU 30 controls a pump 38 to have the ink 4 enter and leave between an ink tank (not shown) and the second ink tank 32, thereby increasing or decreasing the amount of the ink 4 within the second ink tank 32, so that a height position to be detected by the second liquid level sensor 37 will be the same as a predetermined height position. A second ink channel 41 using a flexible liquid transport tube is provided between this second ink tank 32 and an outflow side ink port of the ink jet head 11.

Then, a cord 34 is turned over a pulley 33, and the first ink tank 31 and the second ink tank 32 are respectively hung at both ends of the cord 34. The height position of the first ink tank 31 and that of the second ink tank 32 change, depending on a rotation position of the pulley 33.

FIG. 5 shows the condition in which the liquid level of the ink 4 within the first ink tank 31 and that of the ink 4 within the second ink tank 32 are both lower than the opening of the nozzle 1 by "−Pn/(ρ·g)". Then, the pressure generated in the ink 4 in the neighborhood of the opening of the nozzle 1 is appropriate pressure Pn.

Here, the relationship of channel resistance R1 from the first ink tank 31 to the neighborhood of the nozzle 1 in the pressure chamber 3 and channel resistance R2 from the neighborhood of the nozzle 1 in the pressure chamber 3 to the second ink tank 32 shall be "R=R2(=R0)".

This is considered as such a situation that, in an ink jet apparatus in which the ink 4 does not circulate, two sets of configurations for maintaining the appropriate pressure (negative pressure) of the ink 4 in the neighborhood of the opening of the nozzle 1 are juxtaposed by using the potential pressure, and printing is possible without circulating the ink 4 as it is.

Figure 6:
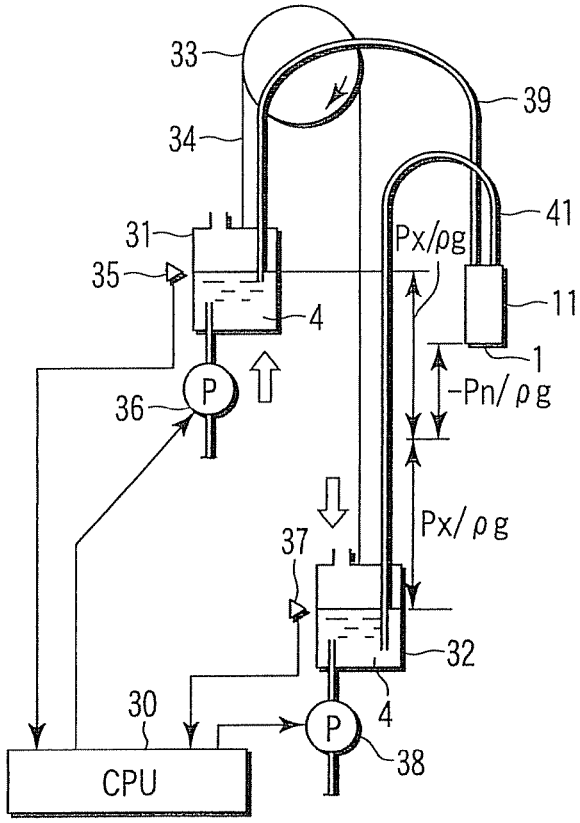
FIG. 6 is a view for illustrating pressure control of fourth embodiment.

Then, the pulley 33 is turned clockwise as shown in FIG. 6.

When the first ink tank 31 ascends by a distance "Px/(ρ·g)", the second ink tank 32 descends by "Px/(ρ·g)", which causes a stream of the ink 4 within the pressure chamber 3 of the ink jet head 11. Then, the ink flow rate Q is expressed as "Q=Px/R0" by using the R0(=R1=R2).

Loss (Pa) of the "energy per unit volume" due to the channel resistance from the first ink tank 31 to the neighborhood of the nozzle 1 in the pressure chamber 3 is expressed by "R0·Q" and is equal to the increase Px in the "energy per unit volume" P1 of the ink 4 within the first ink tank 31 that results from the ascent of the first ink tank 31 by the distance of "Px/(ρ·g)". In addition, the loss (Pa) of the "energy per unit volume" due to the channel resistance from the vicinity of the nozzle 1 in the pressure chamber 3 to the second ink tank 32 is expressed by "R0·Q", and is equal to the decrease Px in the "energy per unit volume" P2 of the ink 4 within the second tank 32 that results from the descent of the second ink tank 32 by the distance of "Px/(ρ·g)".

Therefore, the pressure of the ink 4 in the neighborhood of the opening of the nozzle 1 remains unchanged and the appropriate pressure Pn is maintained.

Although the ink flow rate Q can be adjusted by a rotation position of the pulley 33, the pressure of the ink 4 in the neighborhood of the opening of the nozzle 1 does not fluctuate even during or after adjustment thereof. That is, the pressure of the ink 4 in the neighborhood of the opening of the nozzle 1 is not associated with the ink flow rate Q, and is always kept at the appropriate pressure Pn.

The case in which the relationship of the channel resistances R1, R2 is "R1=R2(=R0)" has been described as an example. However, if the proportion of the channel resistances R1, R2 is "1:r", an elevating mechanism that provides a proportion "1:r" of the ascent distance of the first ink tank 31 and the descent distance of the second ink tank 32 may be used in place of the pulley 33.

[5] FIFTH EMBODIMENT

Figure 7:
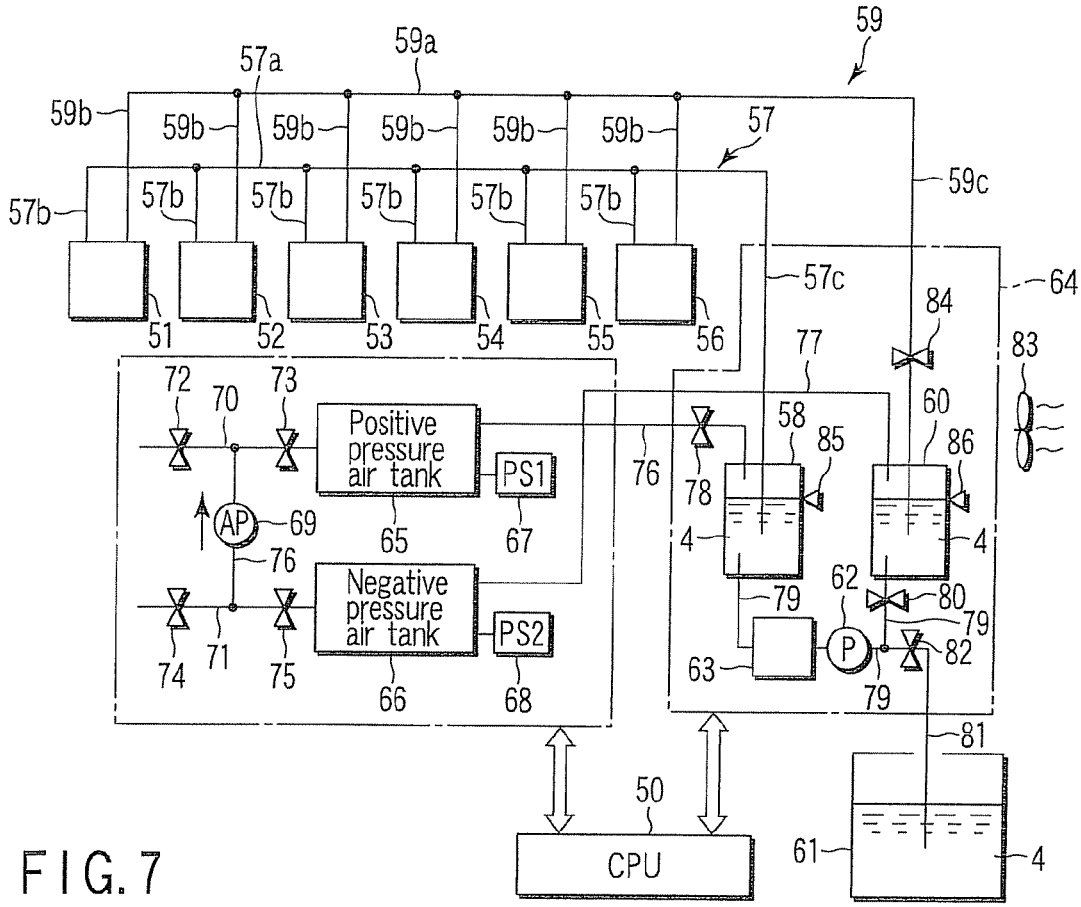
FIG. 7 is a view showing the configuration of the fifth embodiment.

As shown in FIG. 7, a plurality of ink jet heads 51, 52, 53, 54, 55, 56 of ink circulating type are arranged almost horizontally at the same height positions as each other. The basic configuration of these ink jet heads 51 to 56 is identical to the ink jet head 11 as shown in FIG. 1. However, each of the ink jet heads 51 to 56 has 636 pressure chambers, and each pressure chamber 3 is communicated to one nozzle each respectively. These 636 pressure chambers and nozzles 1 are arranged in a direction (depth direction of FIG. 1) orthogonal to the flow direction of the ink 4 in the respective pressure chambers 3.

The ink ejection capability of each of the ink jet heads 51 to 56 is 0.167 (mL/sec) per one head, namely, 636 nozzles. In addition, each pressure chamber 3 in the ink jet heads 51 to 56 has the perimeter of cross section of $7.6\times10^{-4}$ (m), and the cross-section area of $2.4\times10^{-8}$ ($m^2$).

As first pressure sources, an upstream side ink tank 58 that contains the ink 4 to supply to the ink jet heads 51 to 56, and a positive pressure air tank 65 communicated to a space area of the upstream side ink tank 58 via an air pipe 76 are provided. The upstream side ink tank 58 generates the "energy per unit volume" P1 in the ink 4 therein. This "energy per unit volume" P1 is determined by a height position of the liquid level of the ink 4 within the upstream side ink tank 58 and magnitude of air pressure PS1 within the positive pressure air tank 65. The air pipe 76 comprises an air valve 78.

The ink 4 within the upstream side ink tank 58 is guided into respective inflow side ink ports of the ink jet heads 51 to 56 by the first ink channel 57. The guided ink 4, running through the respective pressure chambers 3 of the ink jet heads 51 to 56, flows out from the outflow side ink ports to the second ink channel 59. The ink 4 outflowed to the second ink channel 59 is guided to the second pressure source.

As second pressure sources, a downstream side ink tank 60 that contains ink 4 flowing out from the ink jet heads 51 to 56, and a negative air tank 66 communicated to a space area of the downstream side ink tank 60 via an air pipe 77 are provided. The downstream side ink tank 60 generates the "energy per unit volume" P2 in the ink 4 therein. This "energy per unit volume" P2 is determined by a height position of the liquid level of the ink 4 within the downstream side ink tank 60 and magnitude of air pressure PS2 within the negative pressure air tank 66.

The upstream side ink tank 58 and the downstream side ink tank 60 each have a cross-section area of 5 ($cm^2$), and a volume of 25 (mL).

The first ink channel 57 are formed by a channel (first channel) 57*a* almost horizontally provided along the direction of arrangement of the ink jet heads 51 to 56, a plurality of channels (second channels) 57*b* that branch from this channel 57*a* and are respectively connected to the inflow side ink ports of the ink jet heads 51 to 56, and a channel (third channel) 57*c* that extends downward from the channel 57*a* and is communicated to the upstream side ink tank 58.

The second ink channel 59 is formed by a channel (fourth channel) 59*a* almost horizontally provided along the direction of arrangement of the ink jet heads 51 to 56, a plurality of channels (fifth channels) 59*b* that branch from this channel 59*a* and are respectively connected to the outflow side ink ports of the ink jet heads 51 to 56, and a channel (sixth channel) that extends downward from the channel 59*a* and is communicated to the downstream side ink tank 60. An opening or closing valve 84 is provided in the channel 59*c*.

A third ink channel 79 is provided between the downstream side ink tank 60 and the upstream side ink tank 58. In the third ink channel 79, a filter 63 is provided to remove any foreign matter mixed into ink 4 and a pump 62.

The upstream side ink tank 58, the first ink channel 57, the ink jet heads 51 to 56, the second ink channel 59, the third ink channel 79, the pump 62, and the filter 63 form a circulating path of the ink 4.

In addition, a main tank 61 that contains the ink 4 and that is opened to the atmosphere is also provided. A fourth ink channel 81 is provided between this main tank 61 and the third ink channel 79 (the side closer to the downstream ink tank 60).

The upstream side ink tank 58 is provided with a first liquid level sensor 85 for detecting a height position of the liquid level of the ink 4 therein, while the downstream side ink tank 60 is provided with a second liquid level sensor 86 for detecting a height position of the liquid level of the ink 4 therein.

A valve 80 is provided on the side closer to the downstream side ink tank 60 than the connecting position of the fourth ink channel 81 in the third ink channel 79. Furthermore, the valve 82 is provided in the fourth ink channel 81.

The "energy per unit volume" of the ink within the main tank 61 is set to be greater than the "energy per unit volume" of the circulating ink at the connecting position of the third ink channel 79 and the fourth ink channel 81.

The positive pressure air tank 64 is provided with a first pressure sensor 67, while the negative pressure air tank 60 is provided with the second pressure sensor 68. The first pressure sensor 67 detects air pressure PS1 within the positive air tank 65, while the second pressure sensor 68 detects air pressure PS2 within the negative air tank 66.

One end of an air pipe 70 is connected to the positive air tank 65, while the other end of the air pipe 70 is opened to the atmosphere. The air pipe 70 is provided with a leak valve 72 for exhaust ventilation and an air valve 73 for breathing. The leak valve 72 is provided with an air resistance that limits the velocity of air when it is opened. One end of the air pipe 71 is connected to the negative air tank 66, while other end of the air pipe 71 is opened to the atmosphere. The air pipe 71 is provided with a leak valve 74 for intaking air and an air valve 75 for breathing. The leak valve is provided with air resistance that limits the velocity of air when it is opened.

One end of an air pipe 76 is connected to a position between the leak valve 74 and the air valve 75 in the air pipe 71, while other end of the air pipe 76 is connected to a position between the leak valve 72 and the air valve 73 in the air valve 70. Then, the air pipe 76 is provided with an air pump 69.

The air pump 69 sucks in air on the side of the air pipe 71, and feeds the sucked air to the side of the air pipe 70. With the operation of this air pump 69, the operations of the leak valves 72, 74, and the operations of the air valves 73, 75, the number of gas molecules within the positive pressure air tank 65 and that in the negative pressure air tank 66 are respectively adjusted.

If it is supposed that the appropriate pressure of the ink 4 in the neighborhood of the opening of the nozzle 1 is Pn, a height position of the liquid level of the ink 4 within the upstream side ink tank 58 and a height position of the liquid level of the ink 4 within the downstream ink tank 60 are both set to a height position where the potential pressure equal to the appropriate pressure Pn is generated, namely, the height position of the opening of the nozzle 1 (as Pn is a negative value, $-Pn/(\rho \cdot g)$ is a positive value).

The upstream side ink tank 58 works as a pressure source of the "energy per unit volume" P1. In this case, the "energy per unit volume" P1 is expressed by the following formula (8):

$$P1=Pn+PS1 \tag{8}$$

If this formula (8) is solved for the air pressure PS1 within the positive pressure air tank 65, the following formula (9) can be obtained:

$$PS1=P1-Pn \tag{9}$$

The downstream side ink tank 60 works as a pressure source of the "energy per unit volume" P2. In this case, the "energy per unit volume" P2 is expressed by the following formula (10):

$$P2=Pn+PS2 \tag{10}$$

If this formula (10) is solved for the air pressure PS2 within the negative pressure air tank 66, the following formula (11) can be obtained:

$$PS2=P2-Pn \tag{11}$$

Here, to keep the pressure of the ink 4 in the neighborhood of the opening of the nozzle 1 at the appropriate pressures Pn, a relationship of the air pressure PS1 and PS2 may be maintained as shown in the following formula (12), by using the formula (5) described in the first embodiment and the formulas (9), (11):

$$\begin{aligned} PS2 &= P2 - Pn \\ &= (r \times Pn) - (r \times P1) \\ &= -r \times (P1 - Pn) \\ &= -r \times PS1 \end{aligned} \tag{12}$$

In other words, CPU 50 may increase or decrease either the number of gas molecules within the positive pressure air tank 65 or that in the negative pressure air tank 66, or both so that pressure PS1 detected by the first pressure sensor and pressure PS2 detected by the second pressure sensor are consistent with the formula (12).

However, the r represents the proportion of the channel resistance of the ink 4 from the upstream side ink tank 58 to the neighborhood of the nozzle 1 in each pressure chamber 3 and the channel resistance of the ink 4 from the neighborhood of the nozzle 1 in each pressure chamber 3 to the downstream ink tank 60.

In this fifth embodiment, the channels 57*c*, 57*a*, 59*c*, 59*a* are shared by a plurality of ink jet heads 51 to 56. The channel resistance in these shared parts is considered being proportionally allotted when the channel resistance of the ink 4 from the upstream ink tank 58 to the neighborhood of the nozzle 1 of each pressure chamber 3 and the channel resistance of the ink 4 from the neighborhood of the nozzle 1 in each pressure chamber 3 to the downstream side ink tank 60 are calculated. In addition, generally, channel parts shared by a plurality of pressure chambers 3 also exist in the inside of respective ink jet heads 51 to 56. The same also applies to these shared parts, and they are considered being proportionally allotted to respective pressure chambers 3. A method of proportional allotment later will be described.

In the case of r=1, in particular, the formula (12) is further simplified to formula (13):

$$PS2 = -PS1 \tag{13}$$

In other words, in this case, CPU 50 may increase or decrease either the number of gas molecules within the positive pressure air tank 65 or that in the negative pressure air tank 66, or both, so that pressure PS1 detected by the first pressure sensor 67 and pressure PS2 detected by the second pressure sensor 68 have the same magnitude but the reverse sign.

On the one hand, the total circulation flow rate of the ink 4 flowing through the circulating path can be adjusted by increasing or decreasing the difference between detected pressure PS1 and detected pressure PS2. In other words, if the difference between the detected pressure PS1 and the detected pressure PS2 is large, the total circulation flow rate increases. If the difference between the detected pressure PS1 and detected pressure PS2 is small, the total circulation flow decreases. In this embodiment, by using tabular calculation, the total circulation flow rate of the ink 4 running through the circulating path is adjusted so as to be a desired value. A method of this adjustment will be described later.

For the upstream side ink tank 58, the downstream side ink tank 60 and the periphery thereof, a radiator 64 and a cooling fan 83 are provided. This radiator 64 and the cooling fan 83 cools the upstream side ink tank 58, the downstream side ink tank 60, and the periphery thereof.

Figure 11:
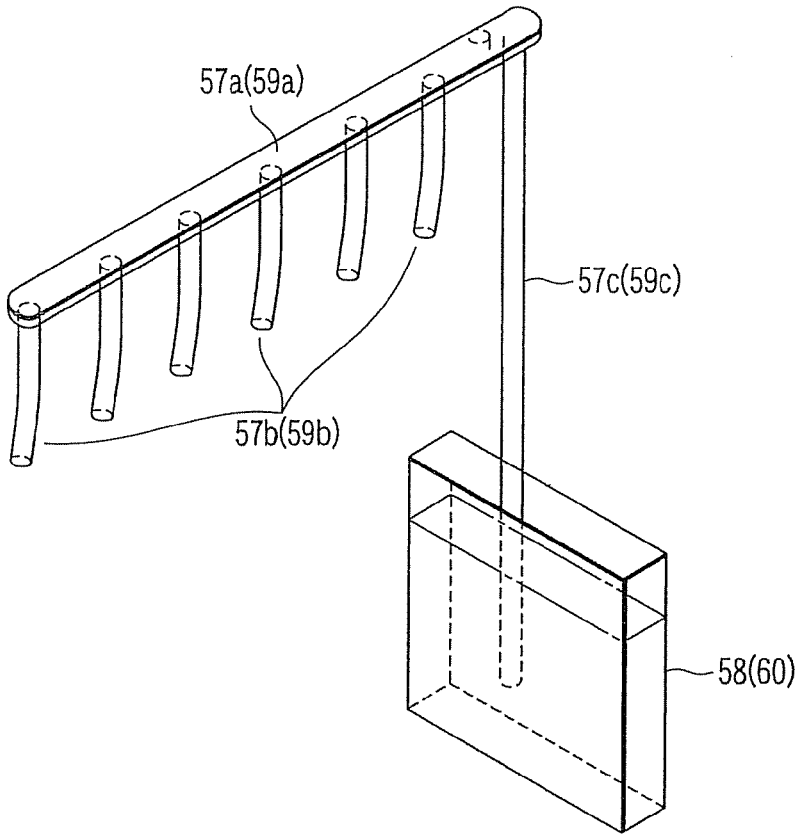
FIG. 11 is a view showing a specific configuration in a first ink channel and a second ink channel of the fifth embodiment.

FIG. 11 shows a specific configuration of the first ink channel 57 and the second ink channel 59.

The ink 4 to be used has a viscosity of 10 (m·Pa·sec), and specific gravity of 0.85. In other words, density ρ is 850 ($kg/m^3$).

The channels 57*a*, 59*a* that are almost horizontally arranged are flat tubes having internal dimensions of 3×10 (mm), for example, and length of 55 (mm) between one of the branching points with the respective channels 57*b*, 57*c*, 59*b*, 59*c* and its adjacent branching point. The respective branching channels 57*b*, 59*b* are thin, flexible tubes having an inside diameter of 3 (mm). The channels 57*c*, 59*c* that extend almost vertically are thick circular tubes having a length of 250 (mm) and inside diameter of 4 (mm).

Suppose that the channel resistance from each channel 57*b* and each channel 57*b* thereof to the neighborhood of each nozzle of the ink jet heads 51 to 56 is R1, the channel resistance between respective branching points in the channel is R2, and the channel resistance of the channel 57*c* is R3. The channel resistance in the channel from the neighborhood of the nozzle 1 in each pressure chamber 3 of the ink jet heads 51 to 56 to each channel 59*b*, and in each channel 59*b* thereof is R1, the channel resistance between respective branching points of the channel 59*a* is R2, and the channel resistance of the channel 59*c* is R3.

These channel resistances are "R1=R1'=$1.67\times10^9$ (Pa·sec/$m^3$)", "R2=R2'=$3.01\times10^7$ (Pa·sec/$m^3$)", and "R3=R3'=$3.98\times10^8$ (Pa·sec/$m^3$)". At this time, the proportion of the channel resistance of the ink 4 at the upstream side from the neighborhood of each nozzle 1 of the ink jet heads 51 to 56 to the ink 4 in the upstream, and the channel resistance of the ink 4 from the neighborhood of each nozzle 1 of the ink jet heads 51 to 56 to the ink 4 in the downstream is "1:1". In other words, now the channel resistance ratio is r=1.

The thickness and shape of the ink channels 57, 59 are selected based on the concept below. If a thin circular tube is used for the ink channels 57, 59, the thin circular tube is easily affected by ink ejection flow because the channel resistance of the ink channels 57, 59 is high, which thus adversely affects the ejection performance or stability of the ink 4 from the ink jet heads 51 to 56. On the contrary, if a thicker circular tube is used for the ink channels 57, 59, air bubbles tend to be left at some locations in each channel when ink 4 is filled. In addition, if the ink channels 57, 59 are too thick, it would physically be difficult to locate them. Thus, in view of these points, the shape and thickness of the ink channels 57, 58 are varied depending on the location.

The channels 57*a*, 59*a* that adopt flat tubes suppress channel resistance by being wider, while making it difficult for air bubbles to remain in the upper part by making the height 3 (mm).

The channels 57*c*, 59*c* that extend vertically have adopted a thicker circular tube having an inside diameter of 4 (mm), to let air bubbles float to the upper part. The floating air bubbles may be sucked out by providing an air bubble blowdown valve (not shown) in the uppermost part of the channels 57*c*, 59*c*, and connecting a syringe or the like to the air bubble blowdown valve. Alternatively, the floating air bubbles in the upper part may be shrunken to the extent that the channel resistance will not be affected, by selecting an appropriate filling procedure when ink is filled, or ink feed rate condition. Air bubbles in the upper part of the channel 57*c* that has adopted the circular tube may be discharged from the nozzles 1 of the ink jet heads 51 to 56, by flowing them away with the ink 4 from the channel 57*c* that has adopted the flat tube to the ink jet heads 51 to 56.

On the one hand, the respective channels 57*b*, 59*b* are independent channels for each of ink jet heads 51 to 56. As the flow rate is small, some channel resistance may exist. Thus, with the higher priority given to how easily the ink 4 can be filled, that is, how easily air bubbles can be eliminated, rather than channel resistance, a thinner tube having an inside diameter of 3 (mm) has been used so that air bubbles can be carried away with the ink in the direction in which the ink runs. In such a configuration, the total circulation flow rate of the ink 4 is set to $1\times10^{-5}$ ($m^3$/sec).

The appropriate pressure Pn is −1300 (Pa), for example. Thus, the liquid level of the ink 4 within the upstream side ink tank 58 and that within the downstream side ink tank 60 are adjusted such that they are simply "$-Pn/(\rho\cdot g)$", that is, 156 (mm) under the opening of each nozzle 1.

Figure 8:
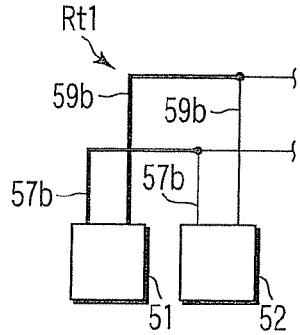
FIG. 8 is a view showing a position of combined channel resistance Rt1 in FIG. 7.
Figure 9:
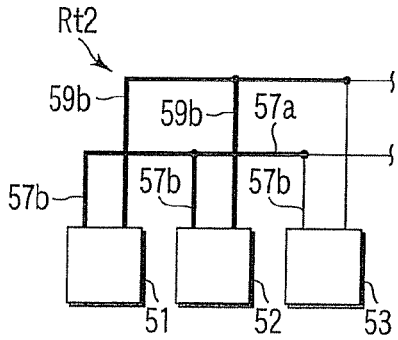
FIG. 9 is a view showing a position of combined channel resistance Rt2 in FIG. 7.
Figure 10:
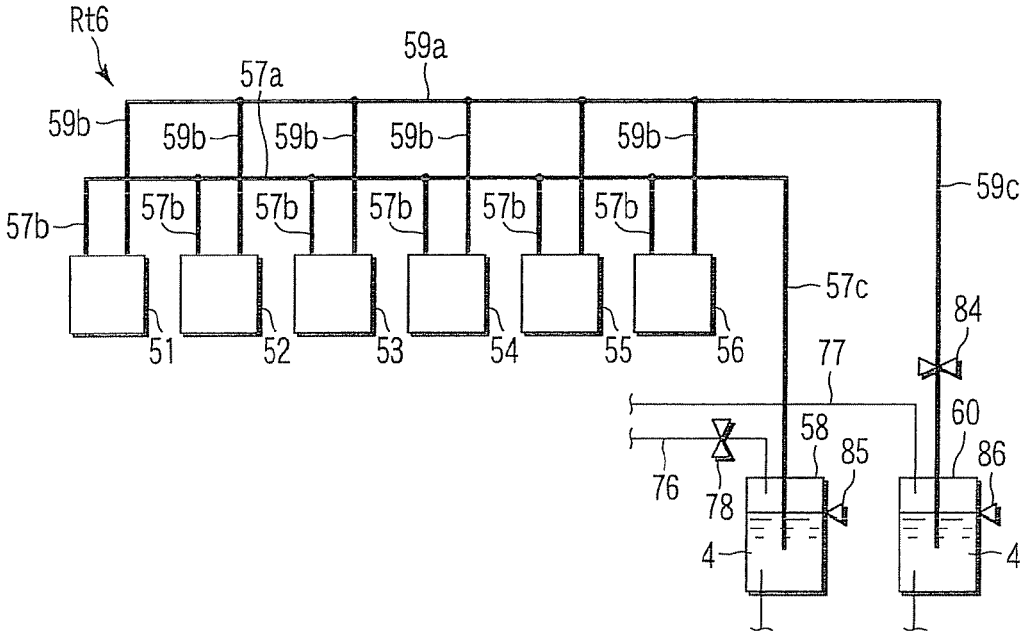
FIG. 10 is a view showing a position of combined channel resistance Rt6 in FIG. 7.

In FIG. 7, the combined channel resistance from the connecting point of the channels 59*b*, 57*b* for the ink jet heads 52 in the channels 59*a*, 57*a* to the ink channels shown left in the figure (including ink channels 59*a*, 59*b*, 57*a*, 57*b* to be connected to the ink jet 51 and the ink jet head 51) is Rt1. In FIG. 8, parts corresponding to this combined channel resistance Rt1 are shown by heavy lines. In addition, the channel resistance from the connecting points of the channels 59*b*, 57*b* for the ink jet head 53 in the channels 59*a*, 57*a* to the ink channels shown left in the figure (including the ink channels 52*a*, 59*b*, 57*a*, 57*b* to be connected to the ink jet heads 51, 51 and the ink jet heads 51, 52) is Rt2. In FIG. 9, parts corresponding to this combined channel resistance Rt2 are shown in heavy lines. Similarly, the channel resistance from the connecting points of the channels 59*b*, 57*b* for the ink jet head 54 in the channels 59*a*, 57*a* to the ink channels shown at left in the figure (including the ink channels 59*a*, 59*b*, 57*a*, 57*b* to be connected to the ink jet heads 51, 51, 52, 53 and the ink jet heads 51, 52, and 53) is Rt3. The channel resistance from the connecting points of the channels 59*b*, 57*b* for the ink jet head 55 in the channels 59*a*, 57*a* to the ink channels shown at left in the figure (including the ink channels 59*a*, 59*b*, 57*a*, 57*b* to be connected to the ink jet heads 51, 52, 53, 54 and the ink jet heads 51, 52, 53, 54) is Rt4. The channel resistance from the connecting points in the channels 59*b*, 57 for the ink jet head 56 in the channels 59*a*, 57*a* to the ink channels shown at left in the figure (including the ink channels 59*a*, 59*b*, 57*a*, 57*b* to be connected to the ink jet heads 51, 52, 53, 54, 55 and the ink jet heads 51, 52, 53, 54, 55) is Rt5. In addition, the combined channel resistance from the upstream side ink tank 58 and the downstream side ink tank 60 to the ink channel 59, the ink channel 57, and the ink jet heads 51 to 56 inclusive is Rt6. In FIG. 10, parts corresponding to this combined channel resistance Rt6 are shown in heavy lines.

The flow rate of the ink flowing from the channel 57*a* to the ink jet head 51 is Q1, the flow rate of the ink flowing from the channel 57*a* to the ink jet heads 51, 52 is Q2, the flow rate of the ink flowing from the channel 57*a* to the ink jet heads 51 to 53 is Q3, the flow rate of the ink flowing from the channel 57*a* to the ink jet heads to 51 to 54 is Q4, the flow rate of the ink flowing from the channel 57*a* to the ink jet heads 51 to 55 is Q5, and the flow rate of the ink flowing from the channel 57*a* to all ink jet heads 51 to 56 (total circulation flow rate of ink 4) is Q6.

The height of the connecting point of the channel 59*b* for respective ink jet heads 51 to 56 in the channel 59*a* is almost equal to that of the connecting point of the channel 57*b* for respective ink jet heads 51 to 56 in the channel 57*a*, a pressure difference Pd1 between the connecting point of the channel 59*b* for the ink jet head 51 in the channel 59*a* and the connecting point of the channel 57*b* for the ink jet head 51 in the channel 57*a* is Pd1, a pressure difference between the connecting point of the channel 59*b* for the ink jet head 52 in the channel 59*a* and the connecting point of the channel 57*b* for the ink jet head 52 in the channel 57*a* is Pd2, a pressure difference between the connecting point of the channel 59*b* for the ink jet head 53 in the channel 59*a* and the connecting point of the channel 57*b* for the ink jet head 53 in the channel 57*a* is Pd3, a pressure difference between the connecting point of the channel 59*b* for the ink jet head 54 in the channel 59*a* and the connecting point of the channel 57*b* for the ink jet head 54 in the channel 57*a* is Pd4, a pressure difference between the connecting point of the channel 59*b* for the ink jet head 55 in the channel 59*a* and the connecting point of the channel 57*b* for the ink jet head 55 in the channel 57 is Pd5, and a pressure difference between the connecting point of the channel 59*b* for the ink jet head 56 in the channel 59*a* and the connecting point of the channel 57*b* for the ink jet head 56 in the channel 57*a* is Pd6. In addition, a difference between the "energy per unit volume" P1 of the ink 4 within the upstream side ink tank 58 and the "energy per unit volume" P2 of the ink 4 within the downstream side ink tank 60 is Pd7.

The ink flow rate in the ink jet head 51 is Qh1, the ink flow rate in the ink jet head 52 is Qh2, the ink flow rate in the ink jet head 53 is Qh3, the ink flow rate in the ink jet head 54 is Qh4, the ink flow rate in the ink jet head 55 is Qh5, and the ink flow rate in the ink jet head 56 is Qh6.

A table calculation sheet into which the values of the channel resistances Rt1 to Rt6 that were calculated from the values of R1, R1', R2, R2', R3, R3', and relational expressions of these channel resistances Rt1 to Rt6 and the ink flow rates Q1 to Q6, pressure differences Pd1 to Pd7, and ink flow rates Qh1 to Qh6 have been entered is created. Then, if numeric values are adjusted so that the total circulation flow rate Q6 of the ink 4 will be "Q6=$1\times10^{-5}$ ($m^3$/sec)", this table calculation sheet will have the value as shown in FIG. 12.

In other words, it is required that the difference Pd7 between the "energy per unit volume" P1 of the ink 4 within the upstream side ink tank 58 and the "energy per unit volume" P2 of the ink 4 within the downstream ink tank 60 be 14993 (Pa).

To make the difference Pd7 of the "energy per unit volume" P1 and P2 be 14993 (Pa) while satisfying the condition "P2=2·(−1300)−P1" of the formula (4), P1=6196 (Pa), and P2=−8796 (Pa).

Then, PS1=−PS2=7496 (Pa).

When the height position of the liquid level of the ink 4 within the upstream side ink tank 58 (the height position detected by the first liquid level sensor 85) is higher than a predetermined height position, the number of rotations of the pump 62 that feeds the ink 4 to the upstream side ink tank 58 is reduced. When it is lower than the predetermined height position, the number of rotations is increased. When the height position of the liquid level of the ink 4 within the upstream side ink tank 58 is the same as the predetermined height position, the volume of fluid transfer of the pump 62 corresponds to "$1\times10^{-5}$ ($m^3$/sec)" that is a set value of the total circulation flow rate.

The valve 82 is opened when the height position of the liquid level of the ink 4 within the downstream side ink tank 60 (height position detected by the second liquid level sensor 86) is lower than a predetermined height position. This allows the downstream ink tank 60 to be refilled with ink 4 within the main tank 61. This refill rate is set to about 5 (mL/sec). This refill rate is determined depending on the "energy per unit volume" of the ink 4 at the connecting point of the third ink channel 79 and the fourth ink channel 81, the "energy per unit volume" of the ink 4 within the main tank 61, and the channel resistance of the fourth ink channel 81 including the valve 82. Thus, their relationships may be adjusted so that the refill rate is about 5 (mL/sec).

The response lag from after the second liquid level sensor 86 detects a height position until the valve 82 operates is 0.1 (sec). The adjustment precision of the liquid level including this response lag is ±5 (mm). Therefore, a potential pressure change corresponding to this height precision is ±42 (Pa), and the range of this pressure change is sufficiently smaller than the absolute value of −1300 (Pa), which is the appropriate pressure Pn of the ink 4 in the neighborhood of the opening of each nozzle.

FIG. 13 shows the operations of the air pump 69, the leak valves 72, 74 and the air valves 73, 74 for adjusting the number of gas molecules within the positive pressure air tank 65 and that within the negative air pressure tank 66.

In other words, there are seven behavior patterns, and as any of these behavior patterns is selectively executed depending on the detection result of the pressure sensors 67, 68, pressure PS1 of the positive pressure air tank 65 and pressure P2 of the negative pressure air tank 66 can be kept at +7496 (Pa) and −7496 (Pa), respectively. For the pressure PS1 of the positive pressure air tank 65, control targeting +7496 (Pa) is exercised. For pressure PS2 of the negative pressure air tank 66, not control directly targeting −7496 (Pa) but control sequentially targeting "−PS1" with varying pressure "PS1" is exercised. This prevents the pressure of the ink 4 in the neighborhood of the opening of each nozzle 1 from deviating from −1300 (Pa), the appropriate pressure, in the process in which pressure PS1 of the positive pressure air tank 65 reaches +7496 (Pa).

In the fifth behavior pattern of FIG. 13, the pump 69 is stopped, and the positive pressure air tank 65 and the negative pressure air tank 66 are leaked to the atmosphere, respectively. Until this condition is reached, the sixth and seventh behavior patterns of FIG. 13 are executed. In other words, pressure PS1 of the positive pressure air tank 65 is adjusted for targeting 0 (Pa). With this adjustment, pressure P2 of the negative pressure air tank 66 is adjusted to be "−PS1". When leaking of the positive pressure air tank 65 and the negative pressure air tank 66 are ended, both pressure PS1 of the positive pressure air tank 65 and pressure PS2 of the negative pressure air tank 66 will be at atmospheric pressure. Then, −1300 (Pa), the potential pressure, is maintained at each of nozzles 1 of the ink jet heads 51 to 56. In this condition, the appropriate pressure Pn can be maintained without any control. If this condition continues, the meniscus can be maintained even if the printing apparatus is not energized, and the curved condition of the meniscus does not change even if a power outage occurs or when the temperature or barometric pressure changes. Furthermore, at shutdown, or the like, neither will ink drip from a nozzle nor air enter. Thus, the normal operation can be promptly resumed upon the next time power is turned on.

With the control described above, the pressure of the ink 4 in the neighborhood of the opening of each nozzle 1 of the ink jet heads 51 to 56 can be always maintained at the appropriate pressure Pn, namely, −1300 (Pa). That is, irrespective of the ink flow rate, the pressure of the ink 4 in the neighborhood of the opening of each nozzle 1 can always be maintained at the appropriate pressure Pn.

(a) A supplemental explanation about the gas volume on the upstream side and that on the downstream side will be given.

It would be more convenient if the gas volume on the upstream side, which is the sum of the volume of the air space of the upstream side ink tank 58, the air pipe 76, and the positive pressure air tank 65, and the gas volume on the downstream side, which is the sum of the volume of the air space of the downstream side ink tank 60, the air pipe 77, and the negative pressure air tank 66 are set to be equal. If the air pump 69 is actuated with the first behavior pattern of FIG. 13 after being opened to the atmosphere with the fifth behavior pattern of FIG. 13, even while the air pump is being actuated, or after its actuation ends, an increase in the number of gas molecules on the upstream side is always equal to a decrease in the number of gas molecules on the downstream side, and the volume remains unchanged. Thus, if the gas volume on the upstream side and that on the downstream side are set equal, simply by actuating the air pump 69, the ink can be circulated while maintaining the condition of PS2=−PS1 of the formula (13), even without control by using the first pressure sensor 67 and the second pressure sensor 68. When the air pump 69 is reversed, the circulation flow rate can be reduced and circulation can even be stopped while maintaining the condition PS2=−PS1 of the formula (13). Therefore, if the gas volume on the upstream side and that on the downstream side are set equal, other behavior patterns in FIG. 13, namely, use of the second, third, fourth, sixth, and seventh behavior patterns can be limited to operations in the case that a slight unbalance, due to air leak from respective connections, or the like, is corrected. Thus, the frequency of switching patterns can be reduced, thereby improving the reliability of the system. Alternatively, if such a use is possible that air leak from respective parts can be ignored during a period from opening to the atmosphere with the fifth behavior pattern to next opening to the atmosphere with the fifth behavior pattern, the second, third, fourth, sixth and seventh behavior patterns of FIG. 13 can be omitted. In this case, the air valves 73 and 75 can be omitted, and the first pressure sensor 67 and the second pressure sensor 68 may be those of lower precision, or either of them may be omitted, or measurement of a differential pressure between the positive pressure air tank 65 and the negative pressure air tank 66 can replace, and the apparatus can be made simpler and cheaper. As the channel resistance ratio is r=1 in this embodiment, "it would be more convenient if the gas volume on the upstream side and gas volume on the downstream side are set equal". However, when the channel resistance ratio of the upstream and downstream sides is "1:r", in general, similar effects to the above description could be obtained if the proportion of the gas volume on the upstream side and that on the down stream side has been set to r:1. In addition, in this embodiment, the initial state is open to the atmosphere, namely, PS1=PS2=0. However, even when the initial state is PS1=PS2=(predetermined value), in general, the circulation flow rate can be controlled simply by actuating the air pump 69 and without changing the ink pressure in the neighborhood of the nozzle opening, if the proportion of the gas volume on the upstream side to that on the downstream side has been set to r:1. This technique can also be applied to any case other than when the liquid level height positions in the upstream side ink tank 58 and the downstream side ink tank 60 are set lower than the opening height position of the nozzle 1, by "$-Pn/(\rho \cdot g)$".

(b) The ink flow rate in each ink jet head will be explained next.

When the total circulation flow rate of the ink 4 is $1\times10^{-5}$ ($m^3$/sec), simply refer to the table calculation sheet of FIG. 12 in order to obtain the values of the ink flow rates Qh1 to Qh6 in each of the ink jet heads 51 to 56.

According to the table calculation sheet of FIG. 12, although the values of the ink flow rates Qh1 to Qh6 fluctuate between $1.50\times10^{-6}$ ($m^3$/sec) to $1.93\times10^{-6}$ ($m^3$/sec), the fluctuations, as far as they are in this range, do not pose any problem because the total circulation flow rate of the ink 4 does not directly affect the ejection operation of the ink 4. As a practical matter, with this idea, print results were compared by changing the ink flow rate Q in the range from 0 ($m^3$/sec) to $1.93\times10^{-6}$ ($m^3$/sec), but no differences in the print result could be distinguished.

(c) The dynamic pressure in the pressure chambers of respective ink jet heads will now be explained.

As described above, each pressure chamber 3 of the ink jet heads 51 to 56 has 636 nozzles 1. The pressure chamber 3 has a cross section area of $2.4\times10^{-8}$ ($m^2$).

When the circulation amount of the ink 4 for the ink jet heads 51 to 56 is $1.93\times10^{-6}$ ($m^3$/sec), the flow rate of the ink 4 flowing through each pressure chamber 3 of the ink jet heads 51 to 56 is $3.03\times10^{-9}$ ($m^3$/sec), and the current velocity is 0.126 (m/sec). The dynamic pressure resulting from this current velocity is negligible, such as:

$$[850(kg/m^3)\times0.126^2(m/sec)]/2=6.7(Pa)$$

and when compared with the absolute value of −1300 (Pa), which is the appropriate pressure Pn of the ink 4 in the neighborhood of the opening of the nozzle 1, it is adequately small and can be ignored. Alternatively, as described above, the appropriate pressure Pn may be set higher by the 6.7 (Pa), from the beginning.

(d) a turbulent flow in the pressure chamber of the ink jet head will be described.

If the Reynolds number Re is calculated, by supposing that the perimeter of each pressure chamber 3 is $7.6\times10^{-4}$ (m), viscosity of the ink 4 is 10 (mPa·sec), and specific gravity of the ink 4 is 0.85, and the flow rate of the ink 4 flowing through each pressure chamber 3 of the ink jet heads 51 to 56 is $3.03\times10^{-9}$ ($m^3$/sec):

$$Re=(4\times3.03\times10^{-9})/\{(0.01/850)\times7.6\times10^{-4}\}=1.36$$

The value of the Reynolds number Re, 1.36 is adequately small and allows the possible effect of a turbulent flow to be ignored.

(e) The temperature control of ink will next be described.

The ink jet heads 51 to 56 generate heat during operation (printing). According to this heat generation, temperatures of the ink 4 vary. If temperatures of the ink 4 widely change, it will affect the ink ejection characteristic. To cope with the temperature change, the radiator 64 and the cooling fan 83 as described above are adopted.

FIG. 14 shows specific configurations of the radiator 64 and the cooling fan 83. The radiator 64 has a heat sink 92 made of aluminum, and enables heat exchange by thermal resistance of 1 (° C./W) between the heat sink 92 and the outer air. The upstream side ink tank 58 and the downstream side ink tank 60 are attached to the heat sink 92. The cooling fan 83 supplies outer air to the heat sink 92, thus cooling the heat sink 92. For example, if 10W, as energy per unit time minus the heat quantity per unit time the ejected ink deprives of the power consumption of the ink jet heads 51 to 56, is given to the circulating ink, temperatures of the ink 4 can be controlled at about +10 (° C.) above the outer air by this cooling.

In FIG. 9, 90 designates a sheet passage unit through which the sheet printed by the ink jet heads 51 to 56 passes, and 91 is a housing in which the ink jet apparatus of the present invention is contained. As the heat sink 92 is provided in the immediate proximity of the sidewall of the housing 91, the heat sink 92 can be directly and efficiently cooled down by outer air.

If an attempt to arrange the upstream side ink tank 58 and the downstream side ink tank 60 at a location that is equidistant from each of the ink jet heads 51 to 56 is made, the location is close to the center of the housing 91. Direct cooling by outer air is difficult around the center of the housing 91. On the other hand, in this embodiment, the upstream side ink tank 58 and the downstream side ink tank 60 are not necessarily arranged at a location that is equidistant from each of the ink jet heads 51 to 56. That is, if the proportion of the channel resistance on the upstream side and that on the downstream side has been set so that it can be "r" for any of the ink jet heads 51 to 56, the pressure of the ink 4 in the neighborhood of the opening of each nozzle 1 of the ink jet heads 51 to 56 can be respectively maintained at the appropriate pressure Pn, and thus the upstream side ink tank 58 and the downstream side ink tank 60 may be arranged on the end of the housing 1. Thus, as described above, a configuration can be adopted wherein the heat sink 92 is provided on the sidewall of the housing 91 and the upstream side ink tank 58, and the downstream side ink tank 60 may be attached to the heat sink 92.

(f) The maintenance will be explained.

A first maintenance method is not only to increase the "energy per unit volume" P1 of the ink 4 within the upstream side ink tank 58 to approximately 22000 (Pa) but also to adjust the "energy per unit volume" P2 of ink 4 within the downstream side ink tank 60 so as to be "−P1", as the change of the "energy per unit volume" P1. This enables the circulation amount of the ink 4 to be almost tripled while the pressure of the ink 4 in the neighborhood of the opening of each nozzle 1 of the ink jet heads 51 to 56 is still maintained at −1300 (Pa), the appropriate pressure Pn. As the ink 4 circulates, foreign matter and air bubbles within the ink jet heads 51 to 56 flow to the downstream side ink tank 60. Air bubbles flown to the downstream side ink tank 60 come up and disappear, foreign matter flown to the downstream side ink tank 60 is filtered by the filter 63, and the ink from which air bubbles and foreign matter were removed is returned to the upstream side ink tank 58. If the circulation amount of the ink 4 increases, these operations can be performed more effectively.

A second maintenance method is to change the "energy per unit volume" P2 of the ink 4 within the downstream side ink tank 60 to "−P1+α". With this, the ink 4 is spilt out from respective nozzles 1 of the ink jet heads 51 to 56. The spilled ink 4 is sucked up by a suction nozzle or scraped up by a blade. Such spilling of the ink 4 can remove foreign matter and air bubbles near the surface of each nozzle 1. If there is any foreign matter or air bubbles near the surface of each nozzle 1, this second maintenance method is effective.

A third maintenance method is to close the valve 84 instantaneously. With this, the ink 4 is spilt out from respective nozzles 1 of the ink jet heads 51 to 56. The spilt ink 4 is sucked up by a suction nozzle or scraped up by the blade. The speed of the ink 4 that flows through respective nozzles 1 is faster in the third maintenance method than in the second maintenance method. That is, the third maintenance method is more effective for contamination inside of respective nozzles 1.

However, if the second maintenance method and the third maintenance method are executed when foreign matter larger than the nozzle 1 lies in the upstream side rather than in the neighborhood of the nozzle 1 in the pressure chamber 3, the foreign matter may be jammed into the nozzle 1. Thus, it would be desirable to execute the second maintenance method and the third maintenance method, after the first maintenance method is executed. A fourth maintenance method takes this into consideration, and is the most powerful method for removing contamination of each nozzle, and has the following sequences.

First, similarly to the first maintenance method, the circulation amount of the ink 4 is increased. Then, similarly to the second maintenance method, the nozzle pressure is shifted slightly to the positive pressure side to cause a tiny amount of the ink 4 to spill from each nozzle 1. In this condition, similarly to the third maintenance method, the valve 84 in the channel 59*c* is instantaneously closed to cause the ink 4 to be spilled rapidly. Then, after returning the valve 84 to the open state, the ink 4 spilled from each nozzle 1 is sucked up by the suction nozzle or scraped up by the blade. Then, after returning the "energy per unit volume" P2 of ink 4 within the downstream side ink tank 60 to "−P1", the ink 4 remaining around each nozzle 1 may be sucked up by the suction nozzle or scraped up by the blade again. Finally, the circulation amount of the ink 4 is returned to normal.

The procedure described herein is not limited to the case in which maintenance of the ink jet apparatus is done, and may be used as a method of washing when the head is washed by using cleaning fluid.

In that case, a washing method can be provided that uses less cleaning fluid and is free from the risk that foreign matter is jammed into the nozzle 1.

(g) The filling of the ink 4 will be explained.

A method of filling the ink 4 in the ink jet heads 51 to 56, the ink channels 57, 59, 79, the upstream side ink tank 58 and the downstream side ink tank 60 from initial empty state will be described next. It is assumed as an initial condition that the main tank 61 contains sufficient ink 4, and either of the positive pressure air tank 65 and the negative pressure air tank 66 is opened to the atmosphere.

The valve 80 is closed, the valve 82 is opened, and the pump 62 is driven at a predetermined number of rotations. With this, the ink 4 within the main tank 61 is supplied to the upstream side ink tank 58. The air valve 78 and the valve 84 are opened.

When the ink 4 in the upstream side ink tank 58 increases and the height position of the liquid level of the ink 4 (the height position detected by the first liquid level sensor 85) reaches a predetermined height position, the air valve 78 is closed. When the air valve 78 is closed, the ink 4 in the upstream side ink tank 58 ascends through the channel 57*c* and flows into the channel 57*a*. The ink 4 that flows into the channel 57*a* runs through each channel 57*b*, and flows into each pressure chamber 3 of the ink jet heads 51 to 56. Then, it is guided from each pressure chamber 3 through each channel 59*b*, the channel 59*a*, and the channel 59*c* into the downstream side ink tank 60.

At the time, if the flow rate of the ink 4 is too high, much of the ink 4 leaks from respective nozzles 1 of the ink jet heads 51 to 56, whereas if the flow rate of the ink 4 is low, filling takes more time. Thus, the flow rate of the ink 4 is set to an appropriate value so that such inconveniences will not occur. In addition, if the ink jet heads 51 to 56 are capped and air tightness of respective nozzles 1 is maintained, the amount of the ink 4 that will spill from respective nozzles 1 can be reduced. Alternatively, if cleaning is done in advance so that there is no liquid or foreign matter around respective nozzles 1 of the ink jet heads 51 to 56, the flow rate at which the ink 4 starts to spill from respective nozzles 1 (at a flow rate of the ink 4 causing spilling of the ink 4 from the respective nozzles when the flow rate of the ink 4 is increased) can be increased. If the edge of a nozzle opening is wet with the ink or there is any foreign matter at the edge of the opening, the ink will freely spread to the outside of the nozzle opening, even if it is a minimal positive pressure. In contrast, if the edge of the nozzle opening is dry, the ink can form a convex droplet at the nozzle opening. In this case, even if the flow rate during filling is high, resulting in a positive pressure in the neighborhood of the nozzle opening, the ink will not spill from the nozzle if the value falls within the positive pressures that can be balanced with the pressure due to surface tension of the droplet. Therefore, it is desirable to clean in advance the periphery of the respective nozzles 1 by a wipe operation, or the like.

If the height position of the liquid level of the ink 4 (height position detected by the second liquid level sensor 86) within the downstream side ink tank 60 reaches a predetermined height position, the air valve 78 and the valve 80 are opened, and the valve 82 is closed. Then, the air pump is started, and then a normal circulating behavior of the ink 4 occurs.

So far, a method of filling by using the air bubbles is described. However, there is some filling method without using the air valve 78. In the following, a method of filling without using the air valve 78 is described.

The valve 80 is closed, the valve 82 is opened, and the pump 62 is driven at predetermined number of rotations. With this, the ink 4 within the main tank 61 is supplied to the upstream side ink tank 58.

When the ink 4 within the upstream side ink tank 58 increases, and the height position of the liquid level of the ink 4 (height position detected by the first liquid level sensor 85) reaches a predetermined height position, the pump 62 is controlled so that the condition can be maintained. For example, when the height position of the liquid level of the ink 4 within the upstream side ink tank 58 is higher than the predetermined height position, the pump 62 is stopped. If the height position of the liquid level of the ink 4 within the upstream side ink tank 58 is lower than the predetermined height position, the pump 62 is driven at a predetermined number of rotations.

With this control, pressure PS1 of the positive pressure air tank 65 is increased. For the ink 4 to pass through the highest point in the ink channel 57, it becomes essential that the pressure PS1 of the positive pressure air tank 65 be higher than potential pressure of true height difference between the highest point in the ink channel 57 and the liquid level of the ink 4 within the upstream ink tank 58. When the ink 4 goes over the highest point in the ink channel 59 after passing through respective pressure chambers 3 of the ink jet heads 51 to 56, it is also a mandatory requirement that the pressure PS1 of the positive pressure air tank 65 be higher than the potential pressure of the true height difference between the highest point in the ink channel 59 and the liquid level of the ink 4 within the upstream ink tank 58.

However, if the pressure PS1 of the positive pressure air tank 65 is too high, a considerable amount of the ink 4 will leak from respective nozzles 1 of the ink jet heads 51 to 56. If the pressure PS1 of the positive pressure air tank 65 is low, filling takes too much time. Thus, the pressure PS1 of the positive pressure air tank 65 is set to an appropriate value that will not cause such inconveniences.

First, the pressure PS1 of the positive pressure air tank 65 may be increased. Then, by judging the time that the ink 4 goes beyond the highest point of the ink channel 57 or the highest point in the ink channel 59, the pressure PS1 of the positive pressure air tank 65 may be decreased. In addition, if the ink jet heads 51 to 56 are capped and air tightness of respective nozzles 1 is maintained, the amount of the ink 4 that will spill from respective nozzles 1 can be reduced. Alternatively, if cleaning is done in advance so that there is no liquid or foreign matter around respective nozzles 1 of the ink jet heads 51 to 56, the pressure of the positive pressure air tank 65 from which the ink 4 starts to spill from respective nozzles 1 (a value of a positive pressure causing spilling of the ink 4 from the respective nozzles when a pressure of the positive pressure air tank 65 is increased) can be increased.

If the height position of the liquid level of the ink 4 (height position detected by the second liquid level sensor 86) within the downstream side ink tank 60 reaches a predetermined height position, the valve 80 is opened, and the valve 82 is closed. Then, pressure PS2 of the negative air tank 66 is controlled to "−PS1", and the "energy per unit voltage" P1 of the ink 4 within the upstream side ink tank 58 is set to a normal value. Then, the normal circulating behavior of the ink 4 occurs.

If the time when operation shifts to the normal circulation control of the ink 4 is set earlier than the time when the height position of the liquid level of the ink 4 within the downstream side ink tank 60 reaches the predetermined height position, the amount of the ink 4 that will spill from respective nozzles 1 can be reduced. To implement this, another liquid level sensor may be provided below the second liquid level sensor 86. Alternatively, based on either the start time of the filling operation or the time when the upstream side ink tank 58 detects the liquid level, or both, it can be estimated and judged when the ink 4 starts to accumulate within the downstream side ink tank 60, and a shift to the normal circulation control may be made when the time is reached.

[6] SIXTH EMBODIMENT

Figure 15:
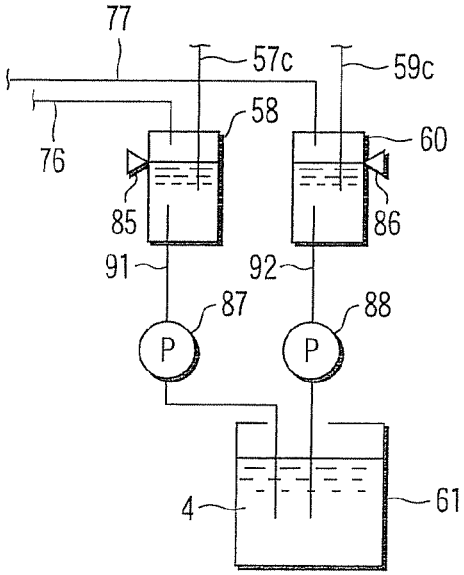
FIG. 15 is a view showing a configuration of a substantial part of the sixth embodiment.

As shown in FIG. 15, the ink channels 91, 92 and the pumps 87, 88 have been adopted in place of the third ink channel 79, the fourth ink channel 81, the valves 80, 82, the pump 62, and the filter 63 of FIG. 7.

The ink channel 91 guides the ink 4 within the main tank 61 to the upstream side ink tank 58. The pump 87 is provided in this ink channel 91. Controlled by CPU 50, the pump 87 increases or decreases the amount of the ink 4 within the upstream side ink tank 58 so that a height position detected by the first liquid level sensor 85 (height position of the liquid level of the ink 4 within the upstream ink tank 58) is the same as the predetermined height position.

The ink channel 92 guides the ink 4 within the main tank 61 to the downstream side ink tank 60. The pump 88 is provided in this ink channel 92. Controlled by CPU 50, the pump 88 increases or decreases the amount of the ink 4 within the downstream side ink tank 60 so that a height position to be detected by the second liquid level sensor 86 (height position of the liquid level of the ink in the downstream ink tank 60) is the same as the predetermined height position.

This case has the advantage that control becomes easier although the number of pumps increases.

Here, the embodiment in which the filter is omitted has been described. However, for the purpose similar to that of the filter 63, a filter may be provided in the ink channel 91.

Other configurations and actions are the same as those of the fifth embodiment. Therefore, description thereof is omitted.

[7] SEVENTH EMBODIMENT

It is desirable that an ink channel has the capability of preventing air bubbles from being mixed, and that of eliminating any mixed air bubbles. This is because once air bubbles are fed to the ink jet heads, some of the air bubbles may enter the pressure chambers, which, as a result, may cause such problems as generation of ink ejection pressure by the actuator being inhibited by air bubbles, ink not being ejected from the nozzles, print quality being deteriorated, or the like. Thus, it is desirable to take the measures described below at ink inflow ports of the upstream side ink tank 58 and the downstream side ink tank 60 in order to prevent air bubbles from getting mixed into ink channels as much as possible.

The ink 4 that can flow into the upstream side ink tank 58 and the downstream side ink tank 60 has current velocity. Even if air bubbles are mixed in this ink 4, they come up to the liquid level of the ink 4 within the ink tanks 58, 60, disappear, and do not flow into the channels 57*c*, 79, if the current velocity of the ink 4 is sufficiently small. However, in the case in which air bubbles are mixed into the ink 4, the current velocity of the ink 4 is high to some extent, and yet air bubbles are small, the buoyancy of air bubbles is not enough to keep them afloat, and so they sink, and stochastically flow into the channels 57*c*, 79.

Even if a flow direction of the ink 4 that flows into the upstream side ink tank 58 and the downstream side ink tank 60 is upward or sideways, the ink will finally impinge against the wall surface of each ink tank, swirl around in the ink tanks, and finally stochastically flow into the channels 57*c*, 79 if the current velocity of the ink 4 is fast enough.

In the ink jet heads of the ink circulating type, in particular, as the current velocity of the ink 4 is fast, such a problem tends to occur. To prevent this, the current velocity of the ink 4 flowing into the upstream side ink tank 58 and the downstream side ink tank 60 may be decelerated. To decelerate the current velocity of the ink 4 flowing into the upstream side ink tank 58 and the downstream side ink tank 60 while maintaining the necessary flow rate, the cross section area of the flow on the side into which each ink flows may be increased.

Figure 16:
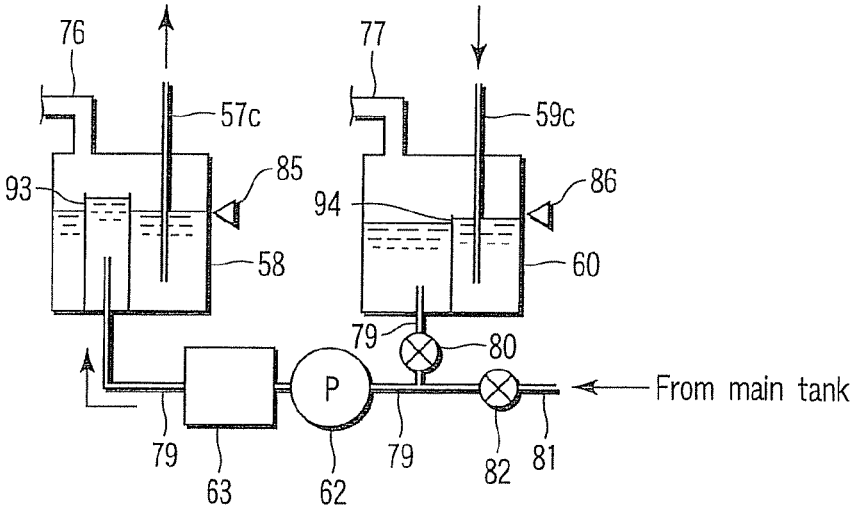
FIG. 16 is a view showing a configuration of a substantial part of the seventh embodiment.

Thus, as shown in FIG. 16, a cylinder 93 is erectly provided as a first decelerating mechanism inside of the upstream ink tank 58. This cylinder 93 divides the interior of the upstream side ink tank 58 into 2 areas. Into the inner area of this cylinder 93 is introduced an outlet of the third ink channel 79 is provided in the inner area of this cylinder 93. The diameter of the cylinder 93 is sufficiently larger than that of the outlet of the third ink channel 79, and set three times larger, for example.

More specifically, the cylinder 93 is a small chamber with the inner area thereof isolated within the upstream side ink tank 58, and is structured to have the ink 4 flowing into the inner area spill over the upper edge (longer than the perimeter of the outlet opening in the third ink channel 79).

The ink 4 flowing into the upstream side ink tank 58 from the third ink channel 79 first enters the cylinder 93. The liquid level of the ink that entered the cylinder 93 rises, running over the top opening (the upper edge) of the cylinder 93 in due time and falling into the outer area of the cylinder 93. As the opening of the cylinder 93 is provided in the top, the ink 4 is then flowing upwards or sideways. Furthermore, the current velocity of the ink 4 is sufficiently low, in accordance with a proportion with the diameter of the cylinder 93 and that of the outlet of the third ink channel 79, or a proportion with the perimeter of the cylinder 93 and that of the outflow of the third ink channel 79.

As the current velocity of the entering ink does not have a downward component and is sufficiently low, even if the ink 4 flow into with small air bubbles mixed, neither sink nor swirl around, and instead slowly come up to the liquid level of the ink 4 and disappear. As the inlet of the channel 57 is provided lower than the opening of the cylinder 93 in the outer area of the cylinder 93, the chance of air bubbles running through the channel 57*c* and being fed into respective ink jet heads 51 to 56 is very low.

On the one hand, as the side ink in the downward ink tank 60 is not directly fed to respective ink jet heads 51 to 56, the level f importance is lower than on the upstream side. However, it is not preferable that air bubbles flow into the third ink channel 79, because flowing into the third channel 79, the air bubbles accumulate in the pump or filter, or pass through the pump or filter, though the chance is low, and return to the upstream tank, therefore circulating in the circulating path if the air bubbles flow into the third channel 79. Thus, as with the case of the upstream side tank, it is desirable that a decelerating mechanism is provided in the downstream side ink tank 60, which makes it difficult to flow into the third ink channel 79.

From the inner bottom to sidewalls of the downstream side ink tank 60, a partition wall 94 is erectly provided as a second decelerating mechanism. This partition wall 94 separates the interior of the downstream side ink tank 94 into one area and another area. The outlet of the ink channel 59*c* is introduced into the one area, while the inlet of the third ink channel 79 is introduced into the other area. The linear length of the upper part of the partition wall 94 is longer than the perimeter of the outlet of the ink channel 59*c*, and set three times longer, for example.

More specifically, the partition wall 94 is a small cell with the inner one area thereof isolated within the downstream ink tank 60, and is structured to have the ink 4 flowing into the inner one area spill over the upper edge (longer than the perimeter of the inlet opening in the ink channel 59*c*).

The ink 4 flowing into the downstream side ink tank 60 from the ink channel 59*c* first enters the one area. The liquid level of the ink that entered the one area rises, running over the top opening (the upper edge) of the partition wall 94 in due time and falling into the other area. At this time, the current velocity of the ink 4 is sufficiently low and the direction thereof is sideways. If air bubbles are contained in the ink 4 flowing into the one area, they neither sink nor swirl around, and come up to the liquid level of the ink 4 and disappear. Therefore, it is almost impossible for air bubbles to enter the third ink channel 79.

As in this embodiment, if the cylinder 93 or the partition wall 94 is provided, respective ink tanks 58, 60 have two different liquid levels bounded by the cylinder 93 or the partition wall 94. The respective ink tanks 58, 60 have liquid level sensors, and we describe in the following which liquid level within the respective ink tanks the liquid level sensors should detect, respectively.

As described earlier, the most important thing needed to eject the ink in a stable manner and with high quality is to keep the pressure of the ink 4 in the neighborhood of the opening of respective nozzles 1 at an appropriate value Pn. To this end, the liquid levels to which channels connecting the upstream side ink tank 58 and the downstream side ink tank 60 with respective ink jet heads 51 to 56 are communicated are more important.

More specifically, to correctly control the "energy per unit volume" P1 of the ink 4 within the upstream side ink tank 58, the liquid level sensor 85 of the upstream side ink tank 58 detects a height position of the liquid level of the ink 4 which lies in the outer area of the cylinder 93 (the side in which the channel 57*c* lies). To correctly control the "energy per unit volume" P2 of the ink 4 within the downstream side ink tank 60, the liquid level sensor 86 of the downstream side ink tank 60 detects a height position of the liquid level of the ink 4 which lies in said one area (the side in which the ink channel 59 lies). If the decelerating mechanism of the downstream side ink tank 60 is a cylinder, the liquid level sensor 86 should be provided within the cylinder surrounded by ink, thus making it difficult to install the liquid level sensor. Thus, in this embodiment, a partition plate is used as a decelerating mechanism, which makes it easier to install an ink liquid level sensor on the side to which the ink is flowing from the side in which the ink channel 59*c* lies, namely, the heads.

Other configurations and actions are the same as those of the first embodiment. Therefore, description thereof is omitted.

[8] EIGHTH EMBODIMENT

Figure 17:
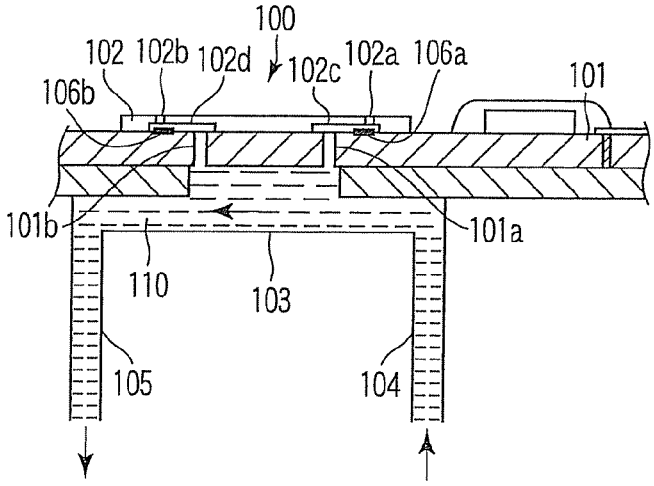
FIG. 17 is a view showing the internal structure of the ink jet head of the eighth embodiment.
Figure 18:
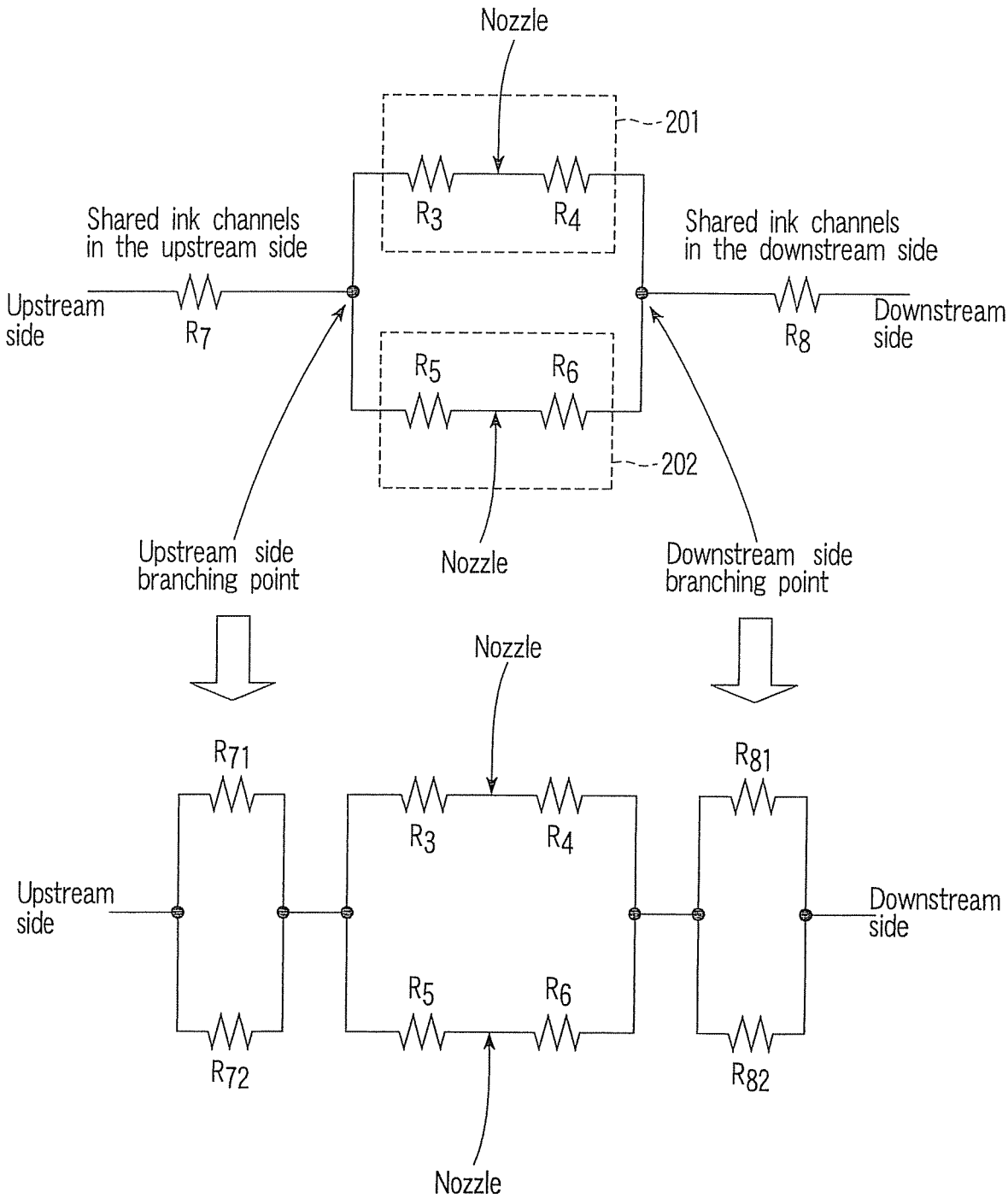
FIG. 18 is an equivalent circuit schematic for illustrating proportional distribution of the channel resistance set forth in the fifth embodiment.

In the first to seventh embodiments, the ink jet head 11 of a circulating type with the configuration as shown in FIG. 1 is used. However, the ink jet head for use is not limited to such, and an ink jet head 100 of a circulating type with the configuration as shown in FIG. 17 may be used.

More specifically, two openings 101*a*, 101*b* are formed on a substrate 101. A plate 102 is provided on a top surface of the substrate and in such a manner that it blocks the openings 101*a*, 101*b*. The plate 102 has pressure chambers 102*c*, 102*d* and ink ejecting nozzles 102*a*, 102*b* in positions corresponding to said openings 101*a*, 101*b*, respectively. In addition, an ink deposit section 103 is provided on the undersurface side of the substrate 101 into which the ink 110 flows through ink channels 104, 105. The ink 110 within the ink deposit section 103 is guided through said openings 101*a*, 101*b* into the pressure chambers 102*c*, 102*d* and the nozzles 102*a*, 102*b*.

Actuators (heating heaters) 106*a*, 106*b* are provided in positions corresponding to the nozzles 102*a*, 102*b* on the top face of the substrate 101. These actuators 106*a*, 106*b* generate heat due to application of a pulse wave like voltage. This heat generation causes a phase change in the ink 100. With this phase change, air bubbles are generated in ink 110. The pressure of the air bubbles ejects the ink 4 from the nozzles 102*a*, 102*b*.

In this configuration, the ink 4 circulates in the path of the ink channel 104, the ink deposit section 103, and an ink channel 105, and only the ink 104 to be ejected is fed to the pressure chambers 102*c*, 102*d* and the nozzles 102*a*, 102*b* via the openings 101*a*, 101*b*. That is, unlike the first to seventh embodiments, the circulation flow of the ink 4 does not run through the pressure chambers.

The first to seventh embodiments may be carried out by using such the ink jet head 100, considering the "neighborhood of the nozzle 1 in the pressure chamber 3" described in the first to seventh embodiments as the "ink deposit section 103" of this embodiment. More specifically, the channel resistance r represents a proportion of the channel resistance from the ink deposit section 103 to the first pressure source and the channel resistance from the ink deposit section 103 to the second pressure source.

In the configuration, when no ink is ejected or the ink is ejected only slightly from the nozzles 102*a*, 102*b*, the "pressure of ink in the neighborhood of the openings of the nozzles 102*a*, 102*b*" is a value obtained by adding "the potential pressure attributed to a slight difference of elevation between the neighborhood of the nozzle 1 in the pressure chamber 3 and the neighborhood of the opening of the nozzle 1" to the "pressure of the ink in the ink deposit section 103".

The relationship among the three components is equal to the relationship among the "pressure of the ink 4 in the neighborhood of the opening of the nozzle 1", the "pressure in the neighborhood of the nozzle 1 in the pressure chamber 3", and the "potential pressure attributed to a slight difference of elevation between the neighborhood of the nozzle 1 in the pressure chamber 3 and the neighborhood of the opening of the nozzle 1".

In addition, it may be considered that when the ink 4 is ejected, the pressure of the ink in the neighborhood of the opening of the nozzles 102*a*, 102*b* decreases by the pressure obtained by multiplying the ejection flow rate of the ink 4 by the channel resistance from the branching points to the nozzles 102*a*, 102*b* through the openings 101*a*, 101*b* and the pressure chambers of 102*c*, 102*d*.

It is also possible to collectively call the "neighborhood of the nozzle 1 in the pressure chamber" described in the first to seventh embodiments and the "ink deposit section 103" of this embodiment as "the "branching point between the channel communicated from the first pressure source to the second pressure source via the ink jet head and the channel communicated to the nozzle".

Furthermore, the ink jet head 100 used in this ink jet apparatus may be of the type branching in the middle of the circulating path and through the filter, into the actuators 106*a*, 106*b* and the nozzles 102*a*, 102*b*. In this case, the filter may be considered as the branching point.

As the actuators 106*a*, 106*b*, actuators of the piezoelectric type, piezoelectric share mode type, thermal ink jet type or the like are also applicable, in addition to those of the heating type.

[9] The proportional allotment of the channel resistance described in the fifth embodiment will be described.

In the fifth embodiment, the ink channels 57*c*, 57*a*, 59*c*, 59*a* are shared by a plurality of ink jet heads 51 to 56. The channel resistance in these shared parts is allotted to the ink jet heads 1 to 56 when calculating the channel resistance from the upstream side ink tank 58 to respective nozzles 1 and the channel resistance from respective nozzles 1 to the downstream side ink tank 60.

In other words, if the ink channels are not separated for each ink jet head, and have a common ink channel and branching points shared by the plurality of ink jet heads, it can be considered that the common ink channels are proportionally allotted at the same rate as that of respective channel resistances of independent ink channels to which the shared ink channel branches. Thus, the channel resistance can be calculated for each jet head, by proportionally allotting the shared ink channel as parallel resistance having the same rate as that of each of the channels to which the shared ink channel branches.

Here, how to allot the shared ink channels to parallel resistance using an equivalent circuit schematic will be described.

When it is supposed that the channel resistance from the nozzle of the ink jet head 201 to the upstream side branching point is R3, the channel resistance from the nozzle of the ink jet head 201 to the downstream side branching point is R4, the channel resistance from the nozzle of the ink jet head 202 to the upstream side branching point is R5, the channel resistance from the nozzle of the ink jet head 202 to the downstream side branching point is R6, the channel resistance of the shared ink channels on the upstream side is R7, and the channel resistance of the shared ink channels on the downstream side is R8, the channel resistance R7 is considered to be proportionally allotted to the channel resistance R71 and the channel resistance R72 that are mutually parallel connected, and that the channel resistance R8 is considered to be proportionally allotted to the channel resistance R81 and the channel resistance R82 that are mutually parallel connected.

A proportional allotment method is to do so such that the following

"$R71:R72=R81:R82=(R3+R4):(R5+R6)$"

"$1/R7=1/R71+1/R72$"

"$1/R8=1/R81+1/R82$"

conditions are met. At this time,

"$R71:R81=R72:R82=R7:R8$".

After the proportional allotment, the channel resistance in the upstream side of the nozzle of the ink jet head 201 shall be "R71+R3", the channel resistance in the downstream side of the nozzle of the ink jet head 201 shall be "R81+R4", the channel resistance in the upstream side of the nozzle of the ink jet head 202 shall be "R72+R5", and the channel resistance in the downstream side of the nozzle of the ink jet head 202 shall be "R82+R6".

Here, it would be easier to handle if the channel resistances in each part could meet "R3:R4=R5:R6=R7:R8=1:r".

Then, "(R71+R3):(R81+R4)=(R72+R5):(R82+R6)=1:r". In other words, if the proportion of the upstream side channel resistance and the downstream side channel resistance has been completed to "1:r" in each of the independent ink channels and the shared ink channels, it can be stated that the proportion of the upstream side channel resistance and the downstream side channel resistance viewed from the nozzles is "1:r" without actually calculating the channel resistances R71, R72, R81, and R82. The fifth embodiment is made as such.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An ink-jet apparatus comprising:

at least one ink jet head that includes a pressure chamber communicating with a nozzle and ejects ink communicating with the pressure chamber from the nozzle;

a first pressure source that contains ink and generates, to the ink, "energy per unit volume" P1 (Pa) that is based on static ink under atmospheric pressure at a height position of an opening of the nozzle;

a second pressure source that contains ink and generates, to the ink, "energy per unit volume" P2 Pa) that is based on static ink under atmospheric pressure at the height position of the opening of the nozzle, and control means, wherein the first pressure source, the pressure chamber, and the second pressure source are sequentially connected to a first channel and a second channel, and assuming that a proportion of a first channel resistance R1 of the first channel from a branching point to the first pressure source to a second channel resistance R2 of the second channel from the branching point to the second pressure source is "1:r" wherein r=R2/R1, the branching point branches from the first and second channels to the nozzle, the control means maintains the "energy per unit volume" P2 (Pa) in a relationship of "P2={(1+r)×Pn}−(r×P1)" for at least an ink-ejecting time from the nozzle, where the Pn is appropriate pressure of ink near the opening of the nozzle.

2. The apparatus according to claim 1, wherein the appropriate pressure Pn (Pa) is for maintaining a meniscus shape that a surface of ink at the opening of the nozzle curves inside the opening.

3. The apparatus according to claim 1, wherein the appropriate pressure Pn (Pa) falls within 0 (Pa) to −3000 (Pa).

4. The apparatus according to claim 1, wherein loss of the "energy per unit volume" of ink caused by the channel resistances of the first and second channels exceeds 3000 (Pa) during said at least ink-ejecting time from the nozzle.

5. The apparatus according to claim 1, wherein;

when the "energy per unit volume" P1 and the "energy per unit volume" P2 are set to different values to each other and ink is caused to flow between the first pressure source and the second pressure source through the first and second channels at a flow rate Q ($m^3$/sec), the control means controls the "energy per unit volume" P1 to the condition of "P1=Q·R/(1+r)+Pn", based on a total channel resistance R (Pa·sec/$m^3$) of the first and second channels, viewed from the first pressure source and the second pressure source, the flow rate Q, the proportion "1:r", and the appropriate pressure Pn (Pa) of ink near the opening of the nozzle.

6. The apparatus according to claim 1, wherein the ink jet head includes a plurality of the nozzles, a first ink port nearer the first pressure source from each branching point that branches from the first and second channels to each nozzle, and a second ink port nearer the second pressure source from each branching point, and respective proportions of respective channel resistances from said respective branching points to the first ink port and respective channel resistances from said respective branching point to the second ink port are equal to one another.

7. The apparatus according to claim 1, wherein a plurality of the ink jet heads are provided, and respective proportions of respective channel resistances, to the first pressure source, from respective branching points that branch from the first and second channels to the nozzles of respective ink jet heads, and respective channel resistances from the respective branching points to the second pressure source are equal to one another and are "1:r".

8. The apparatus according to claim 1, wherein the first pressure source is a first ink tank having a first ink liquid level;

the first ink tank includes a first ink port and a second ink port;

the second pressure source is a second ink tank having a second liquid level;

the second ink tank includes a third ink port and a fourth ink port;

the first ink port and the third ink port are connected to the first and second channels;

the second ink port and the fourth ink port are connected to first ink feed means;

the first ink feed means conducts entrance and exit of the ink to the second ink port and the fourth ink port such that a detection result obtained by a first liquid level sensor that detects a height of the first ink liquid level, and a detection result obtained by a second liquid level sensor that detects a height of the second ink liquid level respectively indicate predetermined heights; and assuming that a pressure at the first ink liquid level is Pi1 (Pa), a pressure at the second ink liquid level is Pi2 (Pa), a height of the first ink liquid level based on the height position of the opening of the nozzle is h1(m), a height of the second ink liquid level based on the height position of the opening of the nozzle is h2(m), a density of the ink is ρ (kg/$m^3$), and a gravity acceleration is g(m/$s^2$), the "energy per unit volume" P1 and the "energy per unit volume" P2 are "P1=Pi1+ρ·g·h1" and "P2=Pi2+ρ·g·h2".

9. The apparatus according to claim 8, wherein the first ink liquid level communicates with a first atmospheric pressure source that has been subjected to pressure regulation; and the second ink liquid level communicates with a second atmospheric pressure source that has been subjected to pressure regulation.

10. The apparatus according to claim 9, further comprising:

a pump that can moves gas between the first atmospheric pressure source and the second atmospheric pressure source, wherein a proportion of a volume of the first atmospheric pressure source and that of the second atmospheric pressure source is r:1.

11. The apparatus according to claim 8, wherein the first ink feed means includes a second pump that can move ink between the first ink tank and the second ink tank, wherein the first ink tank, the first and second channels, the second ink tank, and the second pump constitutes a circulating path that can circulate ink.

12. An apparatus according to claim 11, further comprising;

a main tank containing ink; and second ink feed means that performs transportation and reception ink between the circulating path and the main tank, wherein the second pump is controlled such that a detection result obtained by the first liquid level sensor indicates a predetermined height; and the second ink feed means is controlled so that a detection result obtained by the second liquid level sensor indicates a predetermined height.

13. The apparatus according to claim 12, wherein the second ink feed means comprises a fourth ink channel connecting the main tank and the circulating path, and a first pump provided in the fourth ink channel, and feeds ink in a direction from the main tank toward the circulating path while the detection result of the second liquid level sensor is lower than the predetermined height and feeds ink in a direction from the circulating path toward the main tank while the second liquid level sensor is higher than the predetermined height.

14. The apparatus according to claim 12, wherein

"energy per unit volume" P3 (Pa) of the main tank that is based on static ink under atmospheric pressure at the height position of the opening of the nozzle, the "energy per unit volume" P1, and the "energy per unit volume" P2 satisfy a relationship of "P1>P3>P2", and the second ink means comprises a fourth ink channel that communicates with the main tank and is connected to the second ink tank, a first valve for controlling connection and disconnection between the second ink tank and the main tank, a fifth ink channel that communicates with the main tank and is connected to the first ink tank, and a second valve for controlling connection and disconnection between the first ink tank and the main tank, opens the first valve while the detection result of the second liquid level sensor is lower than the predetermined height, and opens the second valve while the detection result of the second liquid level sensor is higher than the predetermined level.

15. The apparatus according to claim 8, wherein the first ink feed means comprises a main tank containing ink;

third ink feed means that can move ink between the first ink tank and the main tank; and fourth ink feed means that can move ink between the second ink and the main tank, wherein the third ink feed means performs control such that a detection result obtained by the first liquid level sensor indicates a predetermined height; and the fourth ink feed means performs control such that a detection result obtained by the second liquid level sensor indicates a predetermined height.

16. The apparatus according to claim 8, wherein the first ink feed means conducts entrance and exist of ink through the second ink port and the fourth ink port, so that the detection result obtained by the first liquid level sensor and the detection result obtained by the second liquid level sensor coincide with the height position of the opening of the nozzle, respectively.

17. The apparatus according to claim 8, wherein the first ink feed means conducts entrance and exit of ink through the second ink port and the fourth ink port such that the detection result obtained by the first liquid level sensor and the detection result obtained the second liquid level sensor satisfy "$-Pn/(\rho \cdot g)$" based on the height position of the opening of the nozzle.

18. The apparatus according to claim 8, wherein a pressure at the first ink liquid level is atmospheric pressure; and the first ink feed means conducts entrance and exit of ink through the second ink port such that the liquid level height position detected by the first liquid level sensor satisfies "$P1/(\rho \cdot g)$" based on the height position of the opening of the nozzle.

19. The apparatus according to claim 18, wherein a pressure of the second ink liquid level is atmospheric pressure; and the first ink feed means conducts entrance and exit of ink through the fourth ink port such that the liquid level height position detected by the second liquid level sensor satisfies "$P2/(\rho \cdot g)$" based on the height position of the opening of the nozzle.

20. The apparatus according to claim 8, further comprising:

a radiator that can exchange heat with external air, wherein the first ink tank and the second ink tank together with the radiator are arranged at an end of the apparatus that contacts with external air.

21. The apparatus according to claim 8, wherein said at least one ink jet head is arranged obliquely above the first ink tank, and comprises a first supply pipe that supplies ink upwardly from the first ink tank and has a thickness that enables air bubbles in the ink to ascend together with the ink;

a second supply pipe that horizontally arranged above the first supply pipe, supplies ink from the first supply pipe in a horizontal direction, and has a sectional height that enables air bubbles in the ink to move together with the ink; and a third supply pipe that supplies ink from the second supply pipe to the ink jet head and has a thickness that enables air bubbles in the ink to descend together with the ink.

22. The apparatus according to claim 8, further comprising:

a decelerating mechanism that decelerates an ink flow rate and is provided in an ink port of the first ink port and the second ink port ink port in which ink flows.

23. The apparatus according to claim 22, wherein the decelerating mechanism includes an isolating wall that isolates an area where the ink port in which the ink in the first ink tank flows is provided from an area where the other ink port is provided;

an upper edge of the isolating wall is longer than a perimeter of the opening of the ink port in which the ink flows; and the ink spills over from the upper end of the isolating wall to the area where the other ink port is provided.

24. A method for controlling an ink-jet apparatus comprising:

at least one ink jet head that includes a pressure chamber communicating with to a nozzle and ejects ink communicating with the pressure chamber from the nozzle;

a first pressure source that contains ink and generates, to the ink, "energy per unit volume" P1 (Pa) that is based on static ink under atmospheric pressure at a height position of an opening of the nozzle; and a second pressure source that contains ink and generates, to the ink, "energy per unit volume" P2 (Pa) that is based on static ink under atmospheric pressure at the height position of the opening of the nozzle, wherein the first pressure source, the pressure chamber and the second pressure source are sequentially connected to a first channel and a second channel, the method comprising:

when it is assumed that a proportion of a first channel resistance R1 of the first channel from a branching point to the first pressure source to a second channel resistance R2 of the second channel from the branching point to the second pressure source is "1:r" wherein $r=R2/R1$, the branching point branches from the first and second channels to the nozzle, where the Pn is an appropriate pressure of ink near the opening of the nozzle, maintaining the "energy per unit volume" P2 (Pa) to a relationship of "$P2=\{(1+r)\times Pn\}-(r\times P1)$" for at least an ejecting time from the nozzle.

* * * * *